US009986609B2

(12) United States Patent
Ueno

(10) Patent No.: US 9,986,609 B2
(45) Date of Patent: May 29, 2018

(54) LIGHTING APPARATUS AND LIGHTING SYSTEM

(71) Applicant: PANASONIC INTELLECTUAL PROPERTY MANAGEMENT CO., LTD., Osaka (JP)

(72) Inventor: Saori Ueno, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days. days.

(21) Appl. No.: 15/679,900

(22) Filed: Aug. 17, 2017

(65) Prior Publication Data

US 2018/0063912 A1 Mar. 1, 2018

(30) Foreign Application Priority Data

Aug. 26, 2016 (JP) ..... 2016-165246

(51) Int. Cl.
*H05B 33/08* (2006.01)
*H05B 37/02* (2006.01)

(52) U.S. Cl.
CPC ..... *H05B 33/0842* (2013.01); *H05B 33/0851* (2013.01); *H05B 37/0209* (2013.01)

(58) Field of Classification Search
CPC ..... H05B 37/02; H05B 37/0227; H05B 37/0272; H05B 37/0281; H05B 33/0842; H05B 33/0845; H05B 33/0863; A61M 21/00; A61M 2021/0083; A61M 2205/502; A61M 2205/505; G08C 17/02; G08C 2201/40; G08C 2201/42; G08C 2201/50; G08C 2201/93
See application file for complete search history.

(56) References Cited

U.S. PATENT DOCUMENTS

| | | | | |
|---|---|---|---|---|
| 8,035,320 | B2 * | 10/2011 | Sibert | H05B 37/0245 315/149 |
| 9,358,360 | B2 * | 6/2016 | Toda | A61M 21/00 |
| 9,445,480 | B2 * | 9/2016 | Min | H05B 33/0842 |
| 9,730,302 | B2 * | 8/2017 | Vollmer | H05B 37/0272 |
| 2015/0016088 | A1 | 1/2015 | Shiraichi et al. | |
| 2015/0305126 | A1 | 10/2015 | Maeda et al. | |
| 2016/0074620 | A1 | 3/2016 | Toda et al. | |
| 2017/0265285 | A1 * | 9/2017 | Ueno | H05B 37/0272 |

FOREIGN PATENT DOCUMENTS

| | | | |
|---|---|---|---|
| JP | 2013-171688 | A | 9/2013 |
| JP | 2014-222587 | A | 11/2014 |
| JP | 2015-041614 | A | 3/2015 |
| JP | 2015-207381 | A | 11/2015 |
| JP | 2016-058345 | A | 4/2016 |

* cited by examiner

*Primary Examiner* — Haissa Philogene
(74) *Attorney, Agent, or Firm* — McDermott Will & Emery LLP

(57) ABSTRACT

A lighting apparatus includes: a lighting device; and a controller which receives from a lighting setter, an instruction for causing the lighting device to operate in a predetermined mode, causes the lighting device to operate in the predetermined mode according to first control content, and subsequently receiving the instruction, causes the lighting device to operate in the predetermined mode according to second control content which is modified from the first control content based on first subjective information input to the lighting setter, the first subjective information indicating feedback of a user on the first control content.

18 Claims, 21 Drawing Sheets

LIGHTING APPARATUS AND LIGHTING SYSTEM

CROSS REFERENCE TO RELATED APPLICATION

This application claims the benefit of priority of Japanese Patent Application Number 2016-165246 filed on Aug. 26, 2016, the entire content of which is hereby incorporated by reference.

BACKGROUND

1. Technical Field

The present disclosure relates to a lighting apparatus for use in houses, accommodation facilities, etc., and a lighting system which uses the lighting apparatus.

2. Description of the Related Art

Conventionally, lighting apparatuses which control a lighting device according to control content that meets a user's preference have been proposed. Such a lighting apparatus is capable of, not only simply brightening a room in which the lighting apparatus is installed, but also varying, for example, a brightness level of a lighting device according to time, in response to an instruction issued by a user to the lighting apparatus. Japanese Unexamined Patent Application Publication No. 2016-58345 discloses a technique related to such a lighting apparatus.

SUMMARY

However, whether or not actual control content of a lighting device corresponding to the instruction issued by a user meets the user's preference is unknown until the user actually experiences the control content, and thus there are instances where the control content does not meet the user's preference. For example, a user issues to a lighting apparatus a given instruction for causing a lighting device to perform an operation that meets the user's preference from a predetermined period of time (a few minutes) before a scheduled wake-up time, so that the user can awake pleasantly. However, there are cases where, when the user experiences control content of the lighting device corresponding to the given instruction from the predetermined period of time before the scheduled wake-up time, the user cannot awake pleasantly because the control content does not meet the user's preference. Since the user does not know which parameter should be varied and to what degree the parameter should be varied in order to change the control content to meet the user's preference, it is difficult for the user to finely adjust the control content to change the control content to meet the user's preference.

In view of the above, an object of the present disclosure is to provide a lighting apparatus and a lighting system which are capable of easily obtaining control content of a lighting device that meets a user's preference.

A lighting apparatus according to an aspect of the present disclosure includes: a lighting device; and a controller which receives from a lighting setter, an instruction for causing the lighting device to operate in a predetermined mode, causes the lighting device to operate in the predetermined mode according to first control content, subsequently receives the instruction; and causes the lighting device to operate in the predetermined mode according to second control content which is modified from the first control content based on first subjective information input to the lighting setter, the first subjective information indicating feedback of a user on the first control content.

A lighting system according to an aspect of the present disclosure includes: the above-described lighting apparatus; and the lighting setter connected to the lighting apparatus by wire or radio.

With the lighting apparatus and the lighting system according to an aspect of the present disclosure, it is possible to easily obtain control content of a lighting device which meets a user's preference.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Figure 1:
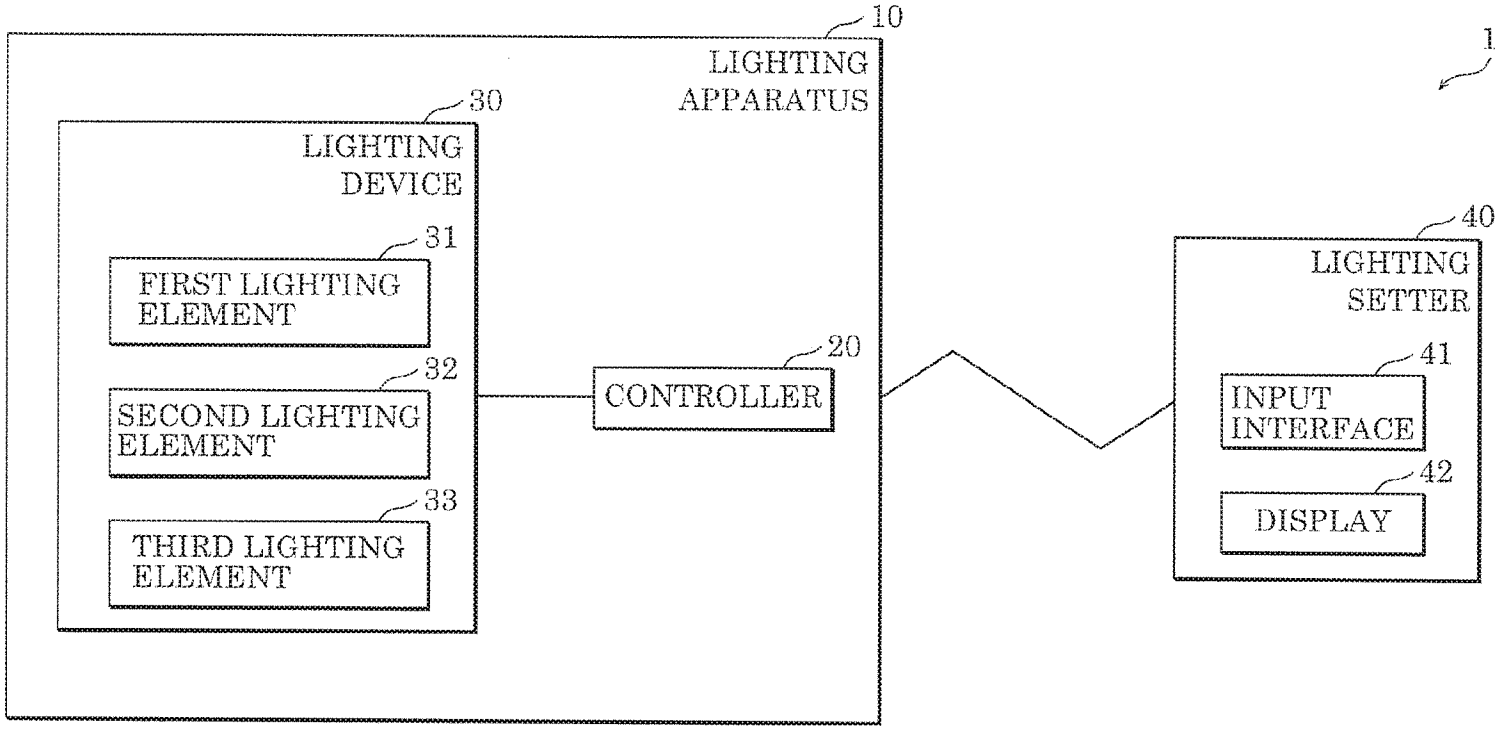
FIG. 1 is a configuration diagram which illustrates an example of the lighting system according to an embodiment.

The following describes in detail embodiments according to the present disclosure, with reference to the drawings. It should be noted that the subsequently-described embodiments show specific preferred examples of the present disclosure. Thus, the numerical values, structural components, the disposition and connection of the structural components, steps (processes), the processing order of the steps, etc. described in the following embodiments are mere examples, and do not intend to limit the present disclosure. Furthermore, among the structural components in the following exemplary embodiments, structural components not recited in the independent claims which indicate the broadest concepts of the present disclosure are described as arbitrary structural components.

In addition, each diagram is a schematic diagram and not necessarily strictly illustrated. Additionally, the same structural components share the same reference numerals in each diagram.

Embodiment

The following describes an embodiment with reference to FIG. 1 to FIG. 21.

(Configuration of Lighting System)

FIG. 1 is a configuration diagram which illustrates an example of lighting system 1 according to an embodiment.

Lighting system 1 includes lighting apparatus 10 and lighting setter 40 connected to lighting apparatus 10 by wire or radio. Lighting system 1 is a system which enables varying, via lighting setter 40, control content (or control parameters) of lighting device 30 included in lighting apparatus 10. Here, the control content indicates, for example, variation of a brightness level, a color temperature, or saturation of light emitted by lighting device 30, according to time. In addition, the control content may indicate fluctuation of a brightness level and a color of light emitted by lighting device 30, according to time. It should be noted that, in the following description, a brightness level, a color temperature, saturation, and a color of light emitted by lighting device 30 (first lighting element 31, second lighting element 32, and third lighting element 33, which will be described later) are also referred to simply as a brightness level, a color temperature, saturation, and a color of lighting device 30, respectively.

Lighting apparatus 10 includes controller 20 and lighting device 30. Lighting apparatus 10 is an apparatus which is operable in a predetermined mode. The predetermined mode is, for example, an awaking mode for causing lighting device 30 to operate according to specific control content on or before a scheduled wake-up time of a user, a sleeping mode for causing lighting device 30 to operate according to specific control content on or before a scheduled time of sleep of a user, or a mode including both of the awaking mode and the sleeping mode. According to the embodiment, the predetermined mode is assumed to include both of the awaking mode and the sleeping mode. Lighting apparatus 10 is capable of causing lighting device 30 to operate according to the control content which enables the user to awake pleasantly when lighting apparatus 10 operates in the awaking mode, and causing lighting device 30 to operate according to the control content which enables the user to easily fall asleep when lighting apparatus 10 operates in the sleeping mode.

Controller 20 (*i*) when receiving, from lighting setter 40, an instruction for causing lighting device 30 to operate in a predetermined mode, causes lighting device 30 to operate according to first control content, and (ii) when subsequently receiving the instruction, causes lighting device 30 to operate according to second control content which is modified from the first control content based on first subjective information that is information input to lighting setter 40 and indicating feedback of a user on the first control content. Details of the operations performed by controller 20 will be given later. Controller 20 is implemented, for example, by a processor or the like which executes a control program stored in a storage (not illustrated) included in lighting apparatus 10. However, controller 20 may be implemented by a microcomputer, a dedicated circuit, or the like.

Lighting device 30 includes first lighting element 31, second lighting element 32, and third lighting element 33. First lighting element 31, second lighting element 32, and third lighting element 33 are lighting devices capable of being independently controlled in brightness and/or color. First lighting element 31, second lighting element 32, and third lighting element 33 are controlled in brightness as a result of controller 20 adjusting light emission. In addition, first lighting element 31, second lighting element 32, and third lighting element 33 each include, for example, a plurality of light sources having different color temperatures. The plurality of light sources are, for example, light sources each including a blue LED and a yellow phosphor. Color of first lighting element 31, second lighting element 32, and third lighting element 33 is controlled by controller 20 adjusting a ratio of light emission among the plurality of light sources. It should be noted that the plurality of light sources may be light sources including, for example, a near-ultraviolet LED and an RGB phosphor. In addition, each of first lighting element 31, second lighting element 32, and third lighting element 33 may include, for example, a red LED, a green LED, and a blue LED. Color of first lighting element 31, second lighting element 32, and third lighting element 33 may be controlled by controller 20 adjusting a ratio of light emission among the red LED, the green LED, and the blue LED. Configurations of first lighting element 31, second lighting element 32, and third lighting element 33 are not specifically limited as long as first lighting element 31, second lighting element 32, and third lighting element 33 are lighting devices capable of being independently controlled in color.

It should be noted that, in the following description, first lighting element 31, second lighting element 32, and third lighting element 33 are described collectively as lighting device 30. However, only one of, only two of, or all of first lighting element 31, second lighting element 32, and third lighting element 33 may perform the operations of lighting device 30 which will be described later.

Figure 2:
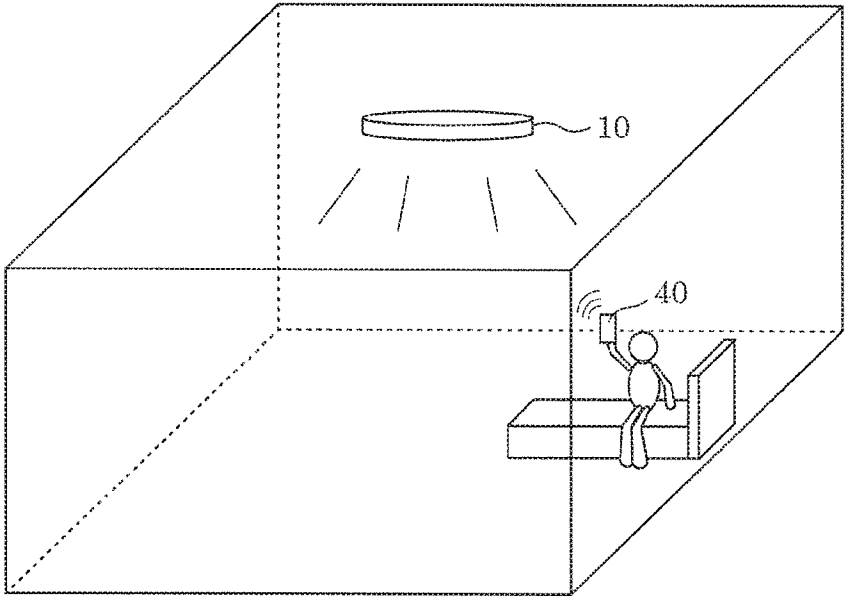
FIG. 2 is a diagram which illustrates an application example of the lighting system according to the embodiment.

Lighting setter 40 is a mobile terminal such as a smartphone, a tablet, etc., or a remote controller, for example, for operating lighting apparatus 10. Lighting setter 40 includes input interface 41 and display 42. Input interface 41 is a user interface such as a button, a touch panel, etc., which receives an operation by a user. Display 42 is, for example, a liquid-crystal display, a touch panel display, etc. It should be noted that, when display 42 is a touch panel display, display 42 may have a function of input interface 42. It is assumed here that display 42 is a touch panel display, and also has a function of input interface 41. An icon for transmitting, to lighting apparatus 10, an instruction for causing lighting device 30 to operate in the predetermined mode is displayed on display 42. In FIG. 2, a user performs a predetermined operation such as tapping the icon on input interface 41 (display 42), for causing lighting apparatus 10 to operate in a predetermined mode, before bedtime, for example. FIG. 2 is a diagram which illustrates an application example of the lighting system according to the embodiment.

At this time, for example, a scheduled wake-up time or a scheduled time of sleep may be input to lighting setter 40 by the user. In this manner, lighting apparatus 10 causes lighting device 30 to operate according to the control content corresponding to the awaking mode from a predetermined period of time (a few minutes, for example) before the scheduled wake-up time, for example, and causes lighting device 30 to operate according to the control content corresponding to the sleeping mode from a predetermined period of time before the scheduled time of sleep. It should be noted that the scheduled wake-up time or the scheduled time of sleep need not be input every day. When the scheduled wake-up time or the scheduled time of sleep is not input, lighting apparatus 10 may cause lighting device 30 to operate from a predetermined period of time before the scheduled wake-up time or the scheduled time of sleep input previously. In addition, when display 42 does not have the function of input interface 41, lighting setter 40 may include, as input interface 41, a dedicated button or the like for causing lighting device 30 to operate in the predetermined mode. Furthermore, lighting setter 40 may transmit to lighting apparatus 10 the instruction for causing lighting device 30 to operate in the predetermined mode, without an operation performed on input interface 41 by a user. In this case, lighting setter 40 has, for example, a timer function, and transmits, at a predetermined time, the instruction for causing lighting device 30 to operate in the predetermined mode, to lighting apparatus 10.

[Fundamental Operation of Lighting Apparatus]

Next, a fundamental operation of lighting device 10 will be described. It should be noted that, as described above, the predetermined mode is assumed to include both the awaking mode and the sleeping mode according to the embodiment.

Figure 3:
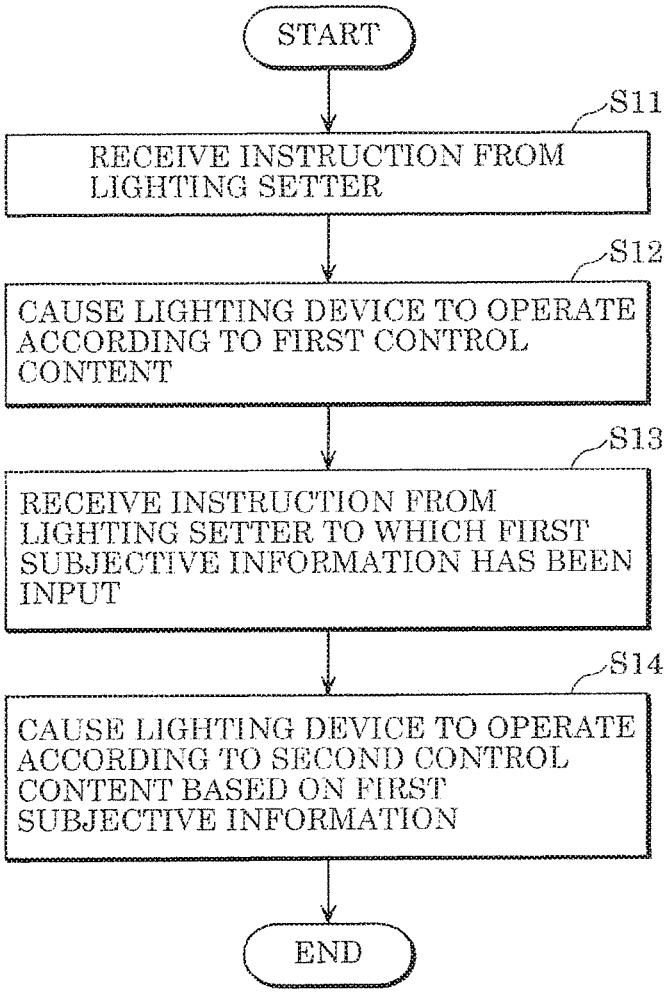
FIG. 3 is a flowchart which illustrates an example of an operation of the lighting apparatus according to the embodiment.

FIG. 3 is a flowchart illustrating an example of an operation of lighting system 10 according to the embodiment.

First, controller 20 receives, from lighting setter 40, an instruction for causing lighting device 30 to operate in a predetermined mode (Step S11). For example, when input interface 41 receives a predetermined operation (for example, tapping an icon, pressing a button, etc.) from a user, lighting setter 40 transmits the instruction to lighting apparatus 10, and controller 20 receives the instruction from lighting setter 40. It should be noted that the instruction is assumed to include the first information for causing, by controller 20, lighting device 30 to operate according to, for example, the first control content in the awaking mode and the sleeping mode.

Next, controller 20 causes lighting device 30 to operate according to the first control content (Step S12). Here, the details of control on lighting device 30 performed by controller 20 is described focusing on the control content in the awaking mode, with reference to FIG. 4.

Figure 4:
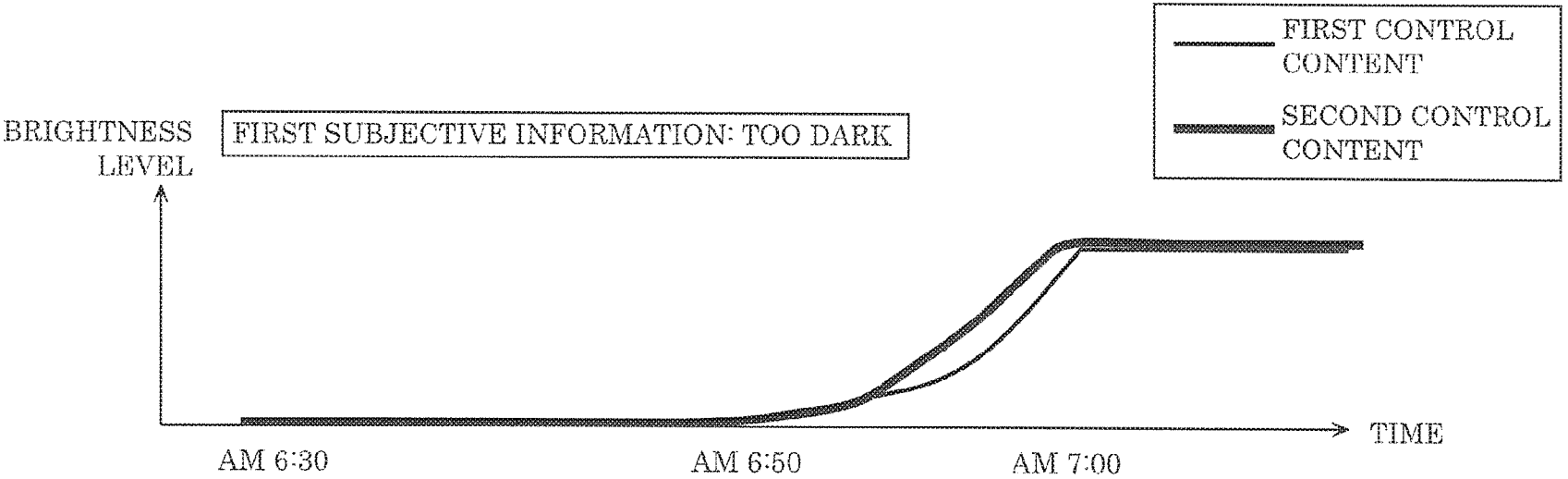
FIG. 4 is a diagram which illustrates an example of control content related to a brightness level of a lighting device in an awaking mode of the lighting apparatus according to the embodiment.

FIG. 4 is a diagram which illustrates an example of control content related to a brightness level of lighting device 30 in the awaking mode of lighting apparatus 10 according to the embodiment.

Controller 20 causes lighting device 30 to operate as indicate by the thin solid line (the first control content) illustrated in FIG. 4. The scheduled wake-up time that is set in advance is, for example, 7 a.m., and controller 20 causes lighting device 30 to operate according to the first control content under which the brightness level of lighting device 30 is gradually increased toward a specific brightness level from a time that is, for example, 10 minute before the scheduled wake-up time, as the predetermined period of time before the scheduled wake-up time. In this manner, controller 20 causes lighting device 30 to emit light at the specific brightness level from the scheduled wake-up time onward. When the brightness level of lighting device 30 instantaneously increases to the specific brightness level at the scheduled wake-up time, it is often the case that a user cannot awake pleasantly. In contrast, when the brightness level of lighting device 30 is gradually increased from a predetermined period of time before the scheduled wake-up time, it is easy to enable a user to awake pleasantly. In addition, although not illustrated, when the brightness level of lighting device 30 is gradually decreased from a predetermined period of time before the scheduled time of sleep, it is easy to enable a user to easily fall asleep.

However, the control content for enabling a user to awake pleasantly and the control content for enabling a user to easily fall asleep differ depending on the preference of the user. For example, some people can awake pleasantly when a bedroom is bright from a predetermined period of time before the scheduled wake-up time, and other people can awake pleasantly when a bedroom is dark from a predetermined period of time before the scheduled wake-up time.

In view of the above, lighting setter 40 (display 42), after controller 20 causes lighting device 30 to operate according to the first control content (for example, after a user awakes), displays an image for enabling the user to input first subjective information. The image for enabling the user to input the first subjective information is an input screen displayed on display 42. Here, the first subjective information will be described with reference to FIG. 5.

Figure 5:
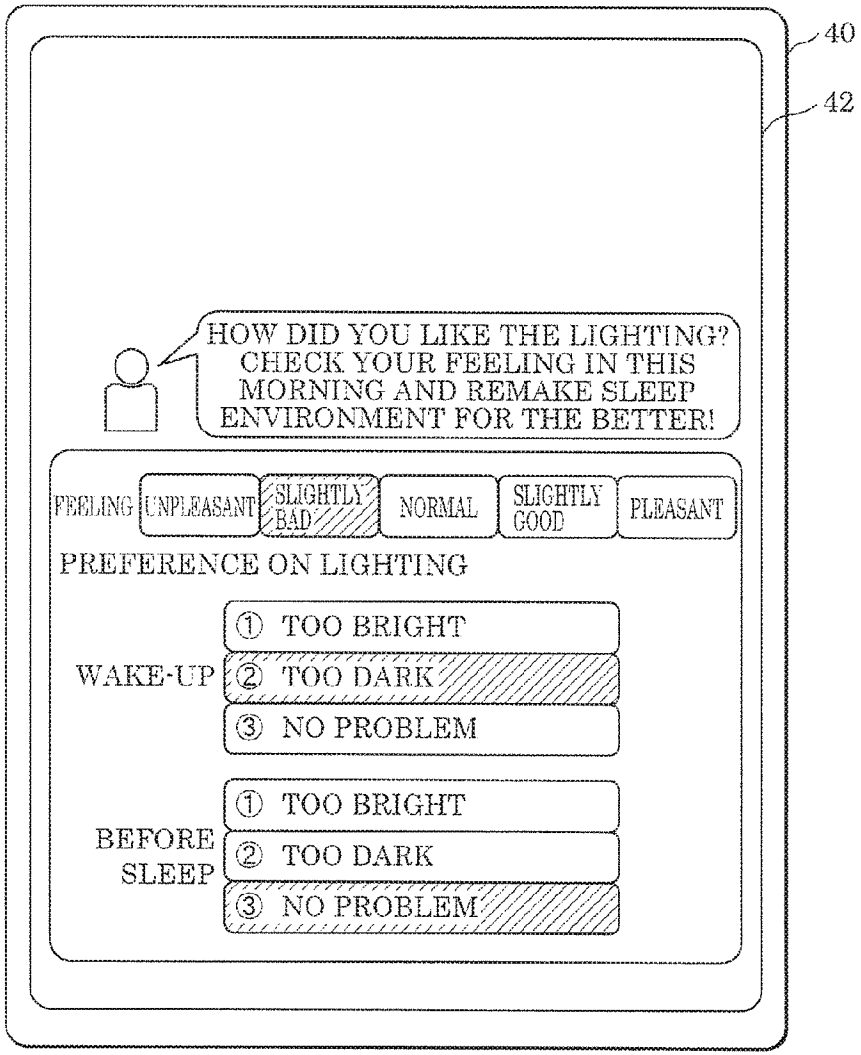
FIG. 5 is a diagram which illustrates an example of a displayed image of the display according to the embodiment.

FIG. 5 is a diagram which illustrates an example of a displayed image of display 42 according to the embodiment.

The subjective information is information indicating feedback of a user on control content. The first subjective information is subjective information indicating feedback of a user on the first control content relating to brightness, for example. More specifically, a user inputs feedback on the first control content of lighting device 30 in the awaking mode, by selecting any of the icons labeled as "too bright", "too dark", and "no problem" in a section indicated by "wake-up" in FIG. 5. In the same manner as above, the user inputs feedback on the first control content of lighting device 30 in the sleeping mode, by selecting any of the icons labeled as "too bright", "too dark", and "no problem" in a section indicated by "before sleep" in FIG. 5. In addition, the user inputs current feeling resulting from experiencing the first control content of lighting device 30 in the sleeping mode and the first control content of lighting device 30 in the awaking mode, by selecting any of the icons labeled as "unpleasant", "slightly bad", "normal", "slightly good", and "pleasant" in a section indicated by "feeling" in FIG. 5. It is assumed here that, as indicated by hatching in FIG. 5, for example, the user inputs "slightly bad" as the current feeling, "too dark" as the brightness level of lighting device 30 in the awaking mode, and "no problem" as the brightness level of lighting device 30 in the sleeping mode.

Then, after the user input the first subjective information, at night of the day, for example, the user performs a predetermined operation on input interface 41 of lighting setter 40. As a result, lighting setter 40 transmits an instruction for causing lighting device 30 to operate in a predetermined mode, to lighting apparatus 10. At this time, although the user performs the same predetermined operation as the operation performed last night (for example, tapping an icon, pressing a button, etc.), lighting setter 40 transmits the instruction including the second information different from the first information, to lighting apparatus 10. The second information is information based on the first subjective information. More specifically, since information indicating that the brightness level of lighting device 30 in the awaking mode was "too dark" and the brightness level of lighting device 30 in the sleeping mode was "no problem" is input as the first subjective information, the second information is information for causing, by controller 20, lighting device 30 to operate in the awaking mode according to the second control content under which the brightness level of lighting device 30 is greater than the brightness level according to the first control content, and to operate in the sleeping mode according to the second control content under which the brightness level of lighting device 30 is the same as the brightness level according to the first control content.

It should be noted that, when information indicating that the brightness level of lighting device 30 in the awaking mode was "too bright" is input as the first subjective information, the second information is information for causing, by controller 20, lighting device 30 to operate in the awaking mode according to the second control content under which the brightness level of lighting device 30 is less than the brightness level according to the first control content. When information indicating that the brightness level of lighting device 30 in the awaking mode was "no problem" is input as the first subjective information, the second information is information for causing, by controller 20, lighting device 30 to operate in the awaking mode according to the second control content under which the brightness level of lighting device 30 is the same as the brightness level according to the first control content.

In the same manner as above, when information indicating that the brightness level of lighting device 30 in the sleeping mode was "too bright" is input as the first subjective information, the second information is information for causing, by controller 20, lighting device 30 to operate in the sleeping mode according to the second control content under which the brightness level of lighting device 30 is less than the brightness level according to the first control content. When information indicating that the brightness level of lighting device 30 in the sleeping mode was "too dark" is input as the first subjective information, the second information is information for causing, by controller 20, lighting device 30 to operate in the sleeping mode according to the second control content under which the brightness level of lighting device 30 is greater than the brightness level according to the first control content.

In addition, to what degree the brightness level of lighting device 30 according to the second control content is made greater or less than the brightness level of lighting device 30 according to the first control content is determined according to, for example, the selected current feeling. More specifically, as a selected icon in the section indicated by "feeling" in FIG. 5 is closer to the icon "unpleasant", the brightness level of lighting device 30 according to the second control content is made, to a greater degree, greater or less than the brightness level according to the first control content. For example, in the case where information indicating that the brightness level of lighting device 30 in the awaking mode according to the first control content was "too dark" is input, the brightness level of lighting device 30 in the awaking mode according to the second control content is increased to a greater degree when "unpleasant" is selected as the current feeling than when "slightly bad" is selected. It should be noted that, in the case where "pleasant" is selected, inputting of feedback on the first control content in the awaking mode and the sleeping mode may be disabled as there is no problem with the brightness level of lighting device 30 according to the first control content in both the awaking mode and the sleeping mode. More specifically, each of the icons in the section indicated by "wake-up" and "before sleep" in FIG. 5 may be grayed out. In this case, it is regarded that information indicating that the brightness level of lighting device 30 in the awaking mode and the sleeping mode was "no problem" is input as the first subjective information, the second information is information for causing, by controller 20, lighting device 30 to operate in the awaking mode and the sleeping mode according to the second control content under which the brightness level of lighting device 30 is the same as the brightness level according to the first control content.

Controller 20 receives an instruction for causing lighting device 30 to operate in a predetermined mode, from lighting setter 40 to which the first subjective information has been input (Step S13). As described above, the instruction includes the second information.

Then, controller 20 causes lighting device 30 to operate according to the second control content which is modified from the first control content based on the first subjective information (Step S14). Controller 20 causes lighting device 30 to operate as indicate by the bold solid line (the second control content) illustrated in FIG. 4. Controller 20 causes lighting device 30 to operate according to the second control content under which the brightness level of lighting device 30 is gradually increased from a predetermined period of time before the scheduled wake-up time, such that the brightness level of lighting device 30 increases faster than the brightness level of lighting device 30 according to the first control content. In addition, the brightness level of lighting device 30 according to the second control content is made greater from the scheduled wake-up time onward than the brightness level of lighting device 30 according to the first control content. In this manner, lighting device 30 is caused to operate according to the second control content which reflects the first subjective information, making it easy to enable a user to awake pleasantly.

However, there are instances where even the second control content which reflects the first subjective information fails to enable a user to awake pleasantly. In view of the above, lighting setter 40 (display 42), after controller 20 causes lighting device 30 to operate according to the second control content, displays an image for enabling the user to input second subjective information. Here, the second subjective information will be described with reference to FIG. 6.

Figure 6:
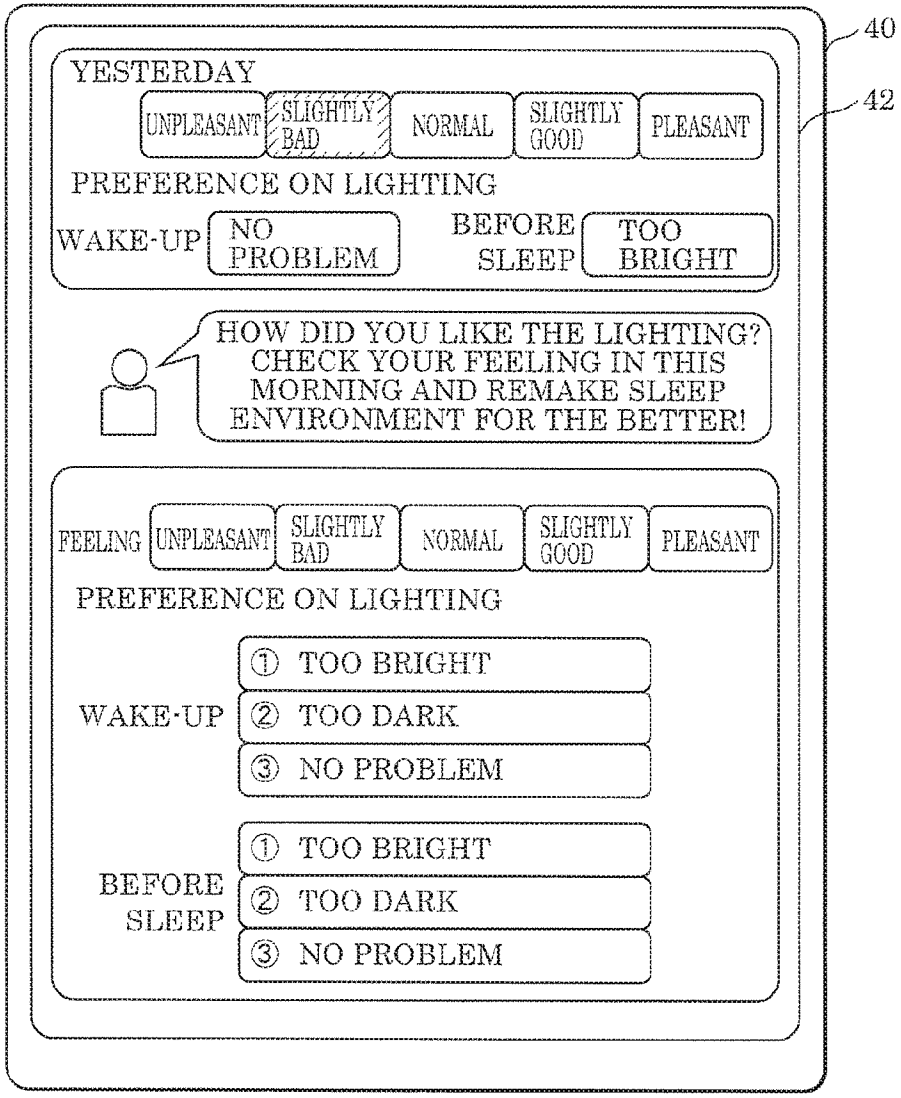
FIG. 6 is a diagram which illustrates another example of a displayed image of the display according to the embodiment.

FIG. 6 is a diagram which illustrates another example of a displayed image of display 42 according to the embodiment.

The second subjective information is information indicating feedback of a user on the second control content. It should be noted that the image for enabling a user to input the second subjective information includes the first subjective information input after controller 20 causes lighting device 30 to operate according to the first control content. For example, as illustrated in FIG. 6, the first subjective information is displayed on the upper side of display 42.

As illustrated in FIG. 6, for example, the first subjective information regarding the first control content of the previous day is displayed for comparison, thereby enabling a user to determine whether or not the second control content is better than the first control content. It should be noted that, among control content items performed on a daily basis for example, one control content item and another control content item performed next to the one control content item are referred to as the first control content and the second control content, respectively. In other words, the first control content is control content based on the subjective information (referred to, for example, as previous subjective information) which indicates the feedback of a user on control content (referred to, for example, as previous control content) performed immediately before the first control content. Accordingly, as illustrated in FIG. 6, display 42 may display a first list of first predetermined comments each indicating the first subjective information for the user to select one of the first predetermined comments, after controller 20 causes lighting device 30 to operate according to the first control content. The displayed image may include the previous subjective information input after controller 20 causes lighting device 30 to operate according to the previous control content.

Then, after the user input the second subjective information, at night of the day, for example, the user performs a predetermined operation on input interface 41 of lighting setter 40. As a result, lighting setter 40 transmits, to lighting apparatus 10, an instruction for causing lighting device 30 to operate in a predetermined mode, and controller 20 causes lighting device 30 to operate according to the control content based on the second subjective information. In this manner, a user inputs on a daily basis, to lighting setter 40, the subjective information which indicates whether or not the current control content is better than the previous control content, and thus the control content of lighting device 30 in a predetermined mode is approximated to the user's preference.

It should be noted that, when lighting apparatus 10 receives for the first time, from lighting setter 40, an instruction for causing lighting device 30 to operate in a predetermined mode, in a state in which subjective information has not yet been input to lighting setter 40 (for example, in a state after initial activation), the control content of lighting device 30 in the predetermined mode is control content determined in advance by a lighting manufacturer, for example.

In addition, as feedback on the first control content of lighting device 30 in the awaking mode and the sleeping mode, in addition to inputting information indicating that lighting device 30 was too bright, too dark, or not problem, a degree of lighting device 30 being too bright or too dark and the timing of lighting device 30 being too bright or too dark before the scheduled wake-up time or before the scheduled time of sleep may further be input. This will be described with reference to FIG. 7.

Figure 7:
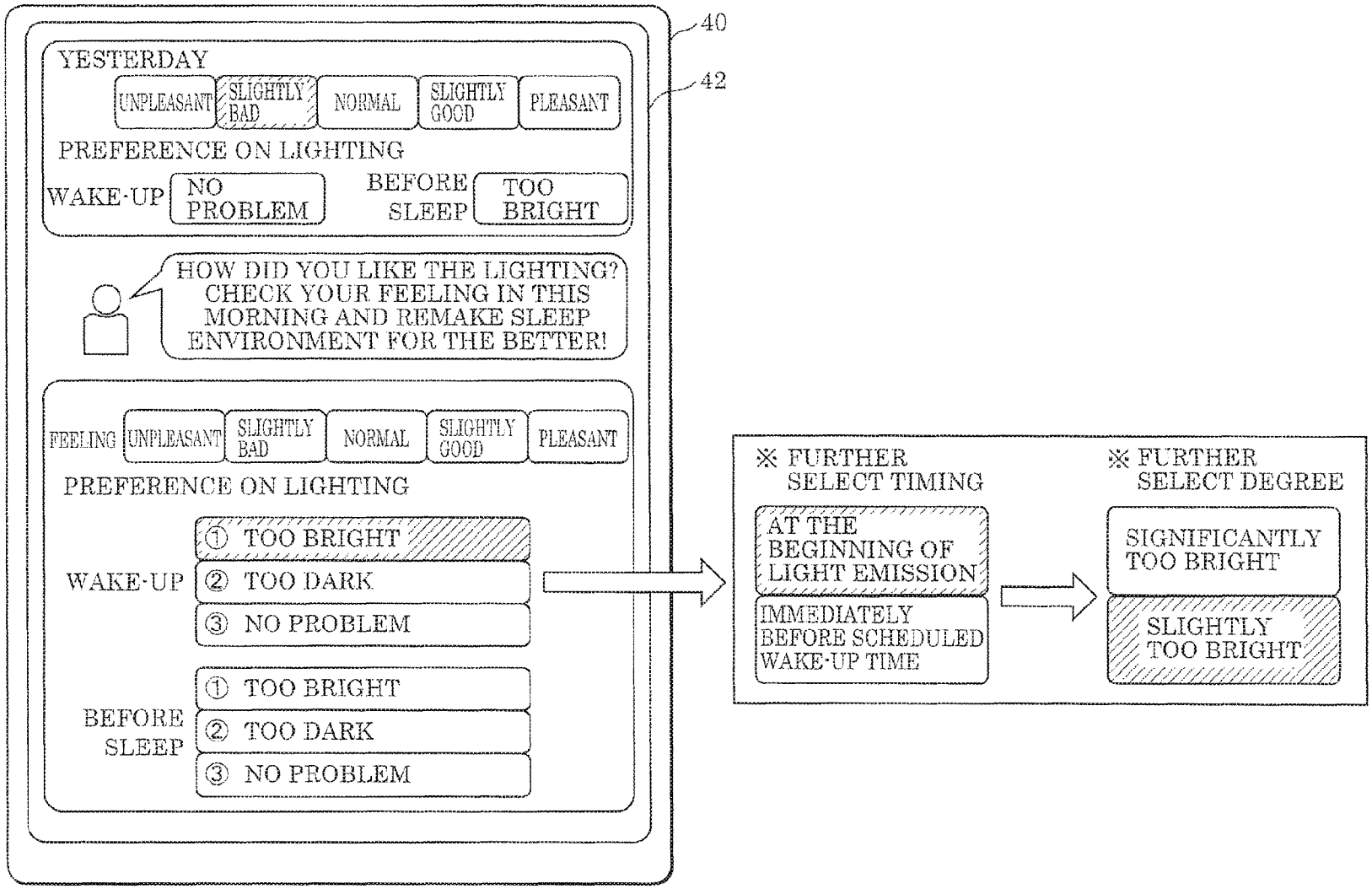
FIG. 7 is a diagram which indicates that detailed subjective information can be input in a displayed image of the display according to the embodiment.

FIG. 7 is a diagram which indicates that detailed subjective information can be input in the displayed image of display 42 according to the embodiment.

As illustrated in FIG. 7, when a user selects, for example, "too bright" regarding lighting device 30 in the awaking mode, the displayed image of display 42 switches to an image for enabling the user to further input information indicating that in which timing before the scheduled wake-up time lighting device 30 was too bright. It is assumed, for example, that "at the beginning of light emission" is selected as the timing. Next, the image displayed by display 42 switches to an image for enabling the user to further input information indicating that to what degree lighting device 30 was too bright. It is assumed, for example, that "slightly too bright" is selected as the degree. With this, the brightness level of lighting device 30 is slightly decreased at the beginning of light emission of lighting device 30 in the awaking mode. In this manner, since the degree of variation in the brightness level at a specific timing can be finely adjusted, it is possible to further approximate the second control content to the user's preference. In other words, it is possible to further approximate the current control content (the second control content) to the user's preference, compared to the previous control content (the first control content). It should be noted that, although two items indicating the timings and two items indicating the brightness levels are displayed as examples, this is not always be the case and three or more items indicating the timings and three or more items indicating the brightness levels may be displayed.

It should be noted that, as described above, lighting device 30 includes first lighting element 31, second lighting element 32, and third lighting element 33. Here, differences between first lighting element 31, second lighting element 32, and third lighting element 33 will be described with reference to FIG. 8.

Figure 8:
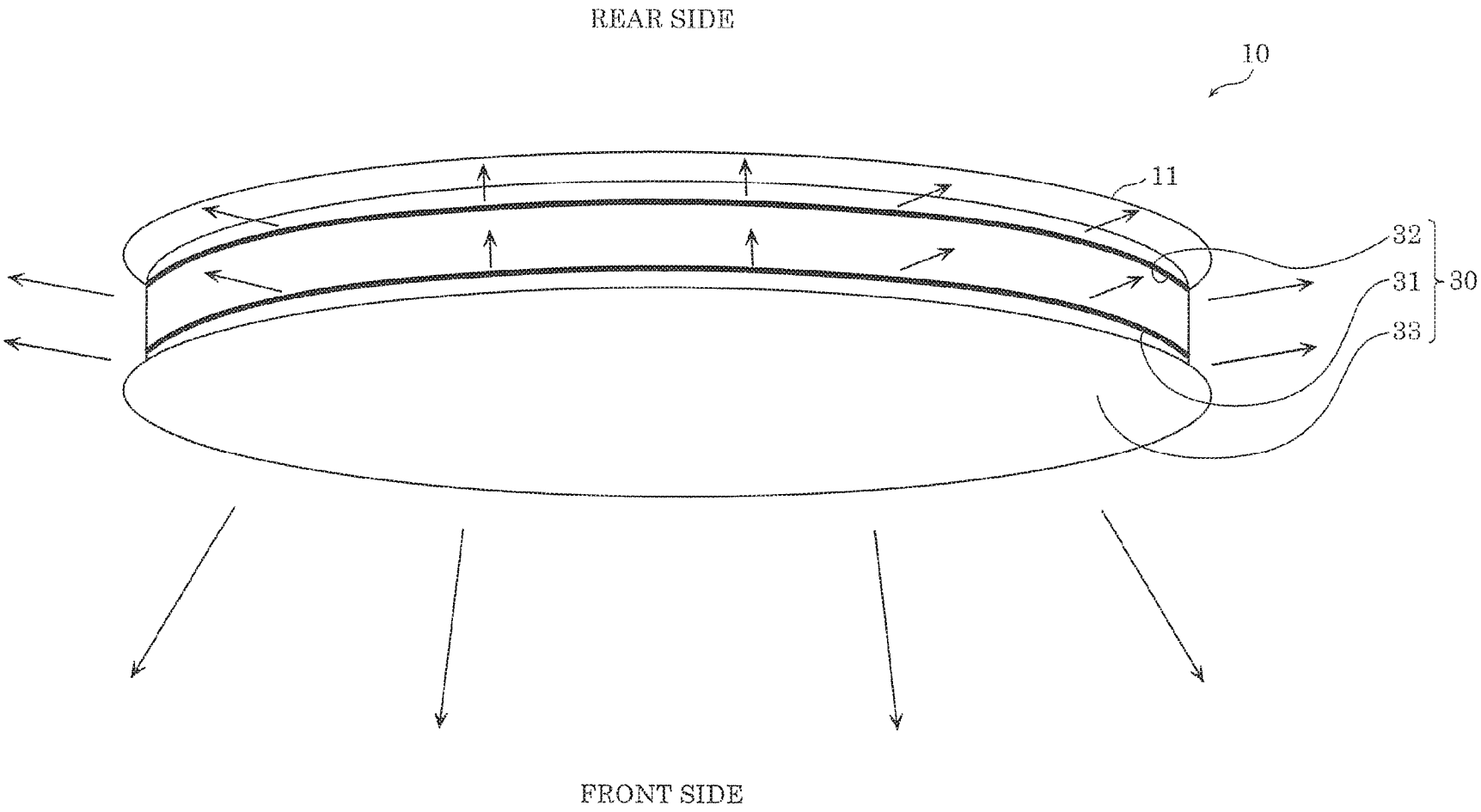
FIG. 8 is a perspective diagram which illustrates an external view of the lighting apparatus according to the embodiment.

FIG. 8 is a perspective diagram which illustrates an external view of lighting apparatus 10 according to the embodiment.

As illustrated in FIG. 8, lighting apparatus 10 is a ceiling light, for example, and includes main body 11*a* body for lighting apparatus 10 to be attached to a structure. Lighting device 30 including first lighting element 31, second lighting element 32, and third lighting element 33 is attached to main body 11. First lighting element 31 is attached to main body 11 so as to emit light in a rearward direction (a ceiling side, for example) toward a structure to which main body 11 is attached. In other words, light emitted from first lighting element 31 is reflected by a ceiling or the like, to be indirect light. Second lighting element 32 is also attached to main body 11 so as to emit light in the rearward direction. Accordingly, light emitted from second lighting element 32 is also indirect light. Third lighting element 33 is attached to main body 11 so as to emit light in a forward direction (a floor side) in a direction opposite to the rearward direction. Accordingly, light emitted from third lighting element 33 is general light (direct light) which directly illuminates the room.

In addition, at least one of first lighting element 31, second lighting element 32, and third lighting element 33 may be turned off in a predetermined mode. For example, third lighting element 33 may be turned off in the predetermined mode. In addition, each of first lighting element 31 and second lighting element 32 may be caused to operate according to different control content. The following describes, as operation example 1 of lighting apparatus 10, an example in which, in a predetermined mode, third lighting element 33 is turned off and each of first lighting element 31 and second lighting element 32 is caused to operate according to different control content.

[Operation Example 1 of Lighting Apparatus]

As described above, first lighting element 31 and second lighting element 32 are lighting devices each capable of being independently controlled in brightness and color. For example, first lighting element 31 emits light of a cold color having a high color temperature, and second lighting element 32 emits light of a warm color having a low color temperature. The following describes control content for causing each of first lighting element 31 and second lighting element 32 to operate, for example, in the awaking mode as a predetermined mode, with reference to FIG. 9.

Figure 9:
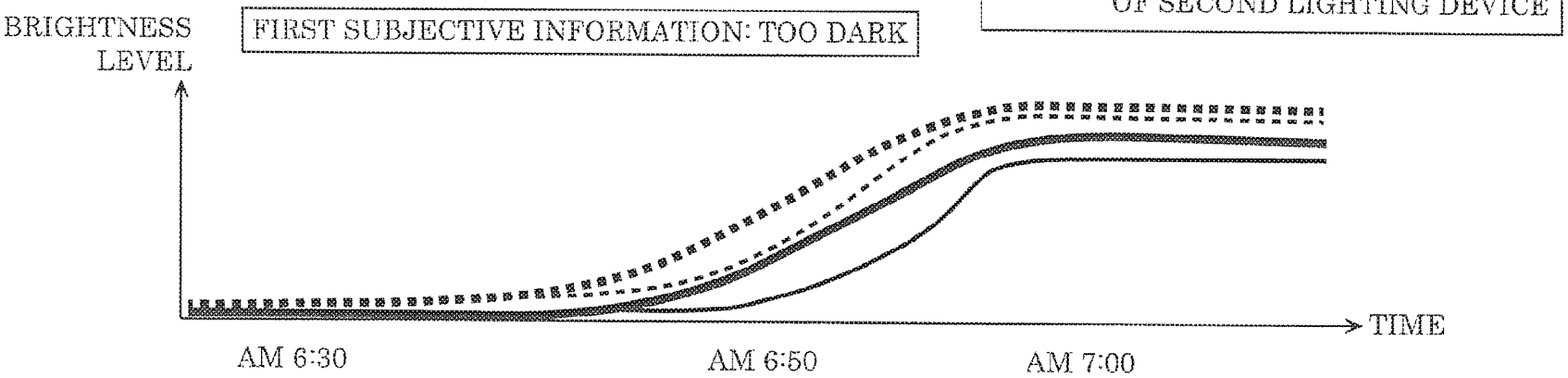
FIG. 9 is a diagram which illustrates an example of control content related to the brightness levels of the first lighting element and the second lighting element in the awaking mode of the lighting apparatus according to the embodiment.

FIG. 9 is a diagram which illustrates an example of control content related to the brightness levels of first lighting element 31 and second lighting element 32 in the awaking mode of lighting apparatus 10 according to the embodiment.

Controller 20 causes first lighting element 31 according to the first control content as indicated by the thin solid line illustrated in FIG. 9, and causes second lighting element 32 according to the first control content as indicated by the thin dashed line illustrated in FIG. 9. For example, first lighting element 31 and second lighting element 32 are each caused to operate according to different first control content such that the brightness level of second lighting element 32 is greater than the brightness level of first lighting element 31, thereby making it possible to generate, by indirect light, gradation similar to morning glow or dusk.

Then, when a user inputs the first subjective information which indicates that first lighting element 31 and second lighting element 32 are too dark, after the user has experienced the control content of first lighting element 31 and second lighting element 32, controller 20 causes first lighting element 31 to operate according to the second control content as indicated by the bold solid line illustrated in FIG. 9 and causes second lighting element 31 to operate according to the second control content as indicated by the bold dashed line illustrated in FIG. 9. The brightness level of each of first lighting element 31 and second lighting element 32 is increased to be greater than the brightness level according to the first control content, on the basis of the first subjective information which indicates that first lighting element 31 and second lighting element 32 were too dark, and first lighting element 31 and second lighting element 32 is caused to operate according to the second control content such that the brightness level of second lighting element 32 is greater than the brightness level of first lighting element 31. In this manner, it is possible to generate gradation while approximating the control content to the user's preference.

It should be noted that third lighting element 33 may be turned on. Since third lighting element 33 is a lighting device which is also capable of being independently controlled in color, it is possible to generate wide-ranging gradation by first lighting element 31, second lighting element 32, and third lighting element 33.

The following describes, as operation example 2 of lighting apparatus 10, an example in which, in a predetermined mode, first lighting element 31 is turned off, and second lighting element 32 and third lighting element 33 are each caused to operate according to different control content.

[Operation Example 2 of Lighting Apparatus]

As described above, second lighting element 32 is attached to main body 11 so as to emit light in a rearward direction. Accordingly, light emitted from second lighting element 32 is indirect light. Third lighting element 33 is also attached to main body 11 so as to emit light in a frontward direction. Accordingly, light emitted from third lighting element 33 is general light. This means that it is possible to implement control content which can enable a user to awake pleasantly and control content which can enable a user to easily fall asleep, by general light and indirect light. In addition, as illustrated in FIG. 10, display 42 may display an image for enabling a user to input which one of indirect light and general light the user prefers, in order to reflect preference between indirect light and general light in control content, as the user's preference.

Figure 10:
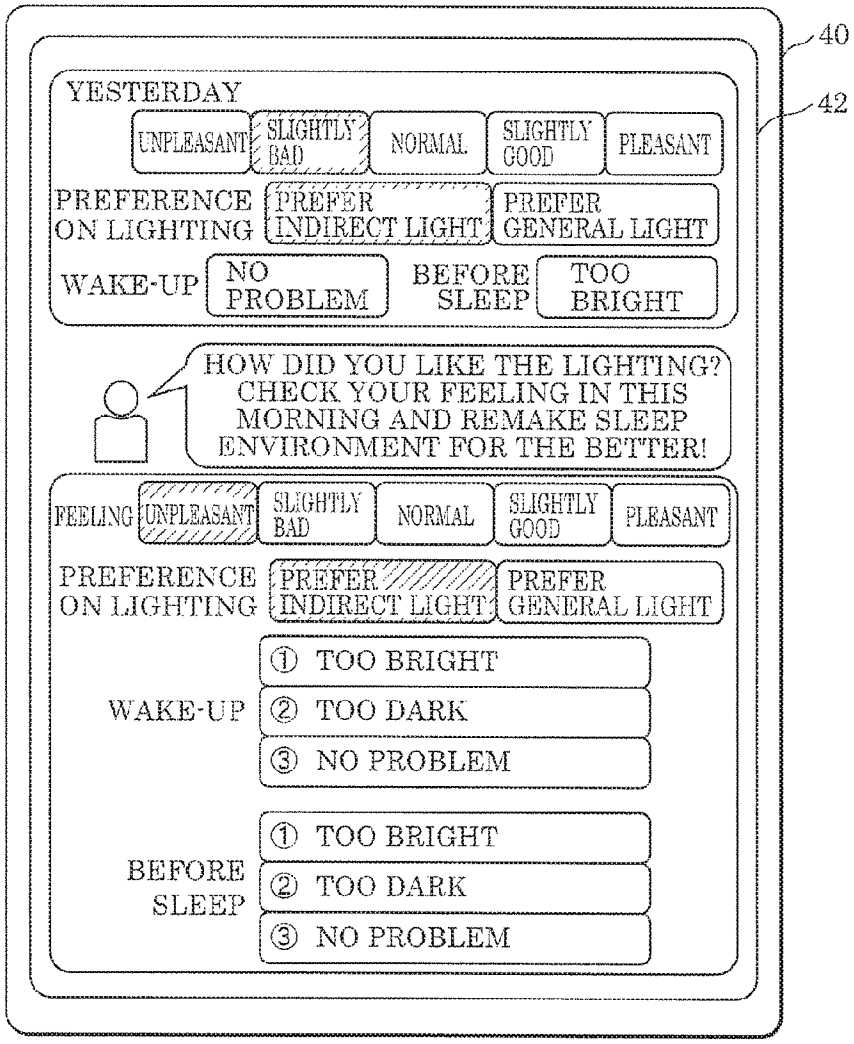
FIG. 10 is a diagram which indicates that subjective information related to preference between indirect light and general light can be input in a displayed image of the display according to the embodiment.

FIG. 10 is a diagram which indicates that subjective information related to preference between indirect light and general light can be input in the displayed image of display 42 according to the embodiment. It should be noted that FIG. 10 illustrates an image displayed by display 42 after second lighting element 32 and third lighting element 33 were caused to operate according to the first control content. The displayed image illustrated in FIG. 10 includes the previous subjective information on the upper side of display 42, so as to facilitate inputting of the first subjective information by a user. As illustrated in FIG. 10, for example, whether or not indirect light is light that the user prefers is input as the first subjective information, by selecting one of icons labeled as "prefer indirect light" and "prefer general light".

Here, an example of control content related to the brightness levels of second lighting element 32 and third lighting element 33 in the sleeping mode or the awaking mode will be described with reference to FIG. 11 to FIG. 14.

Figure 11:
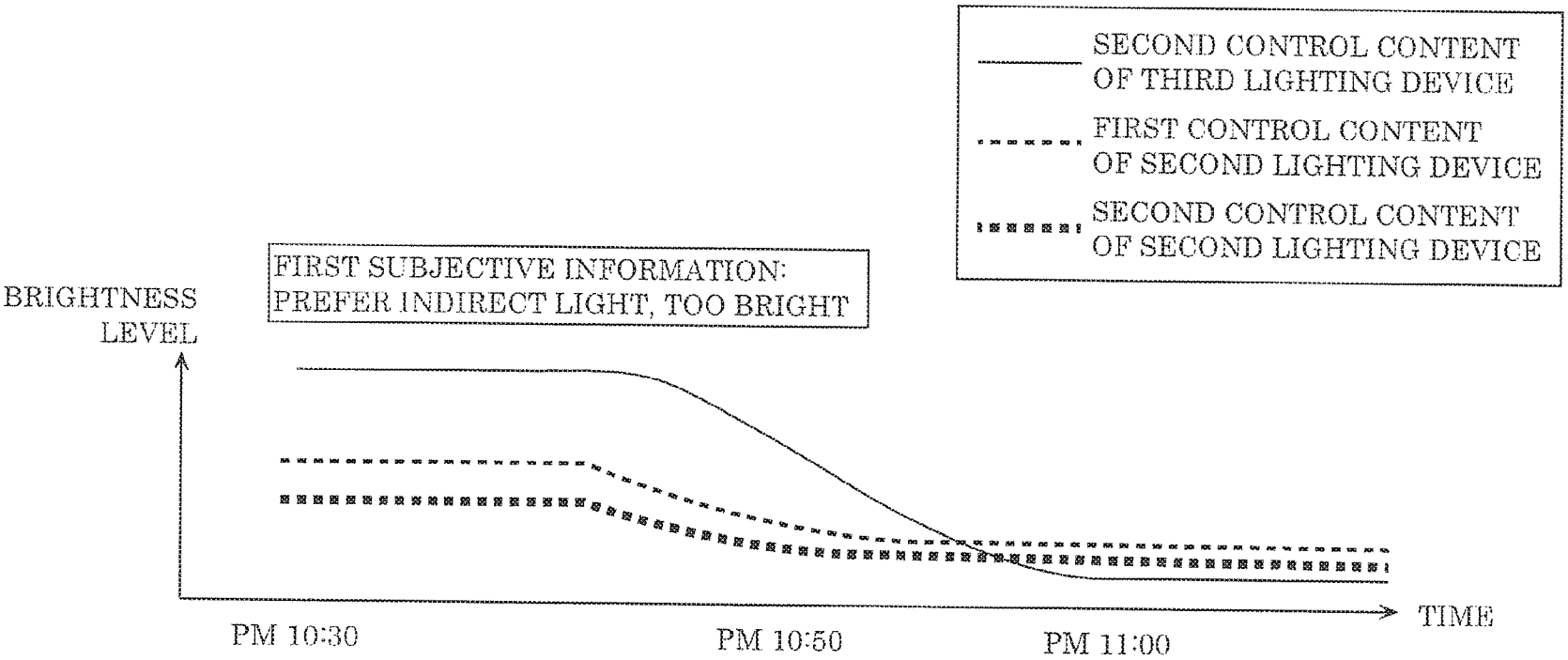
FIG. 11 is a diagram which illustrates an example of control content related to the brightness levels of the second lighting element and the third lighting element in a sleeping mode of the lighting apparatus according to the embodiment.
Figure 12:
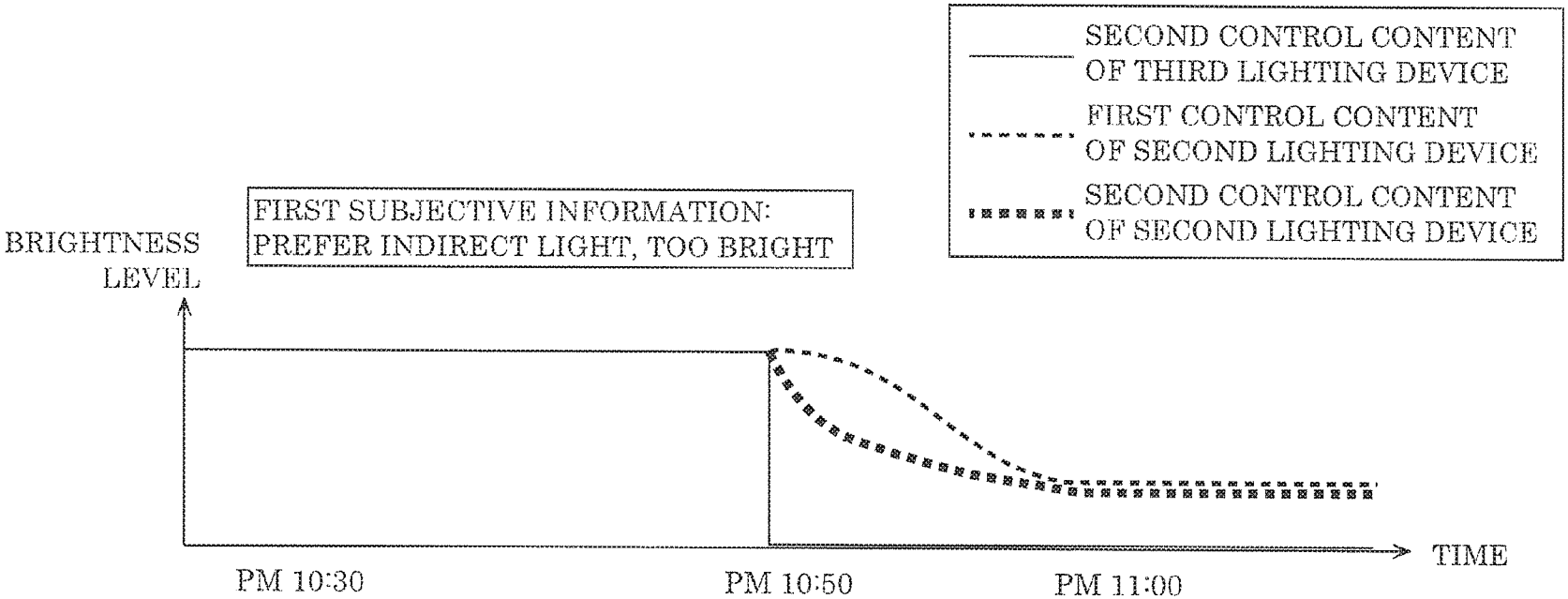
FIG. 12 is a diagram which illustrates an example of control content related to the brightness levels of the second lighting element and the third lighting element in the sleeping mode of the lighting apparatus according to the embodiment.
Figure 13:
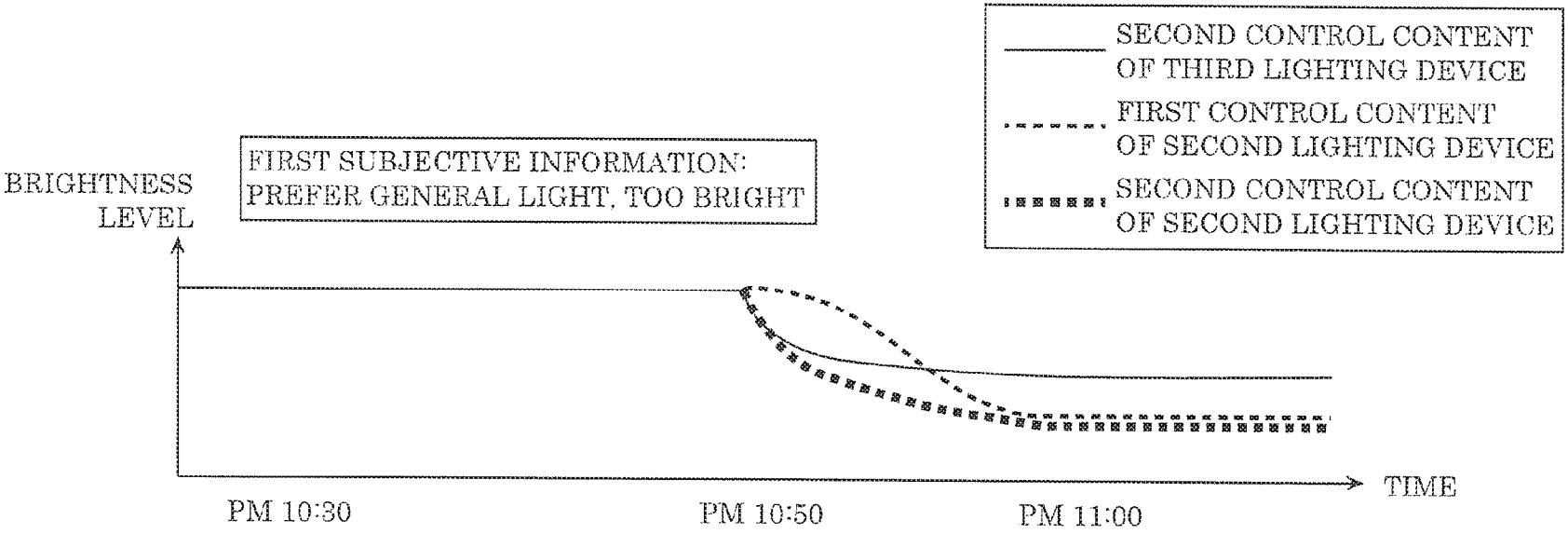
FIG. 13 is a diagram which illustrates an example of control content related to the brightness levels of the second lighting element and the third lighting element in the sleeping mode of the lighting apparatus according to the embodiment.
Figure 14:
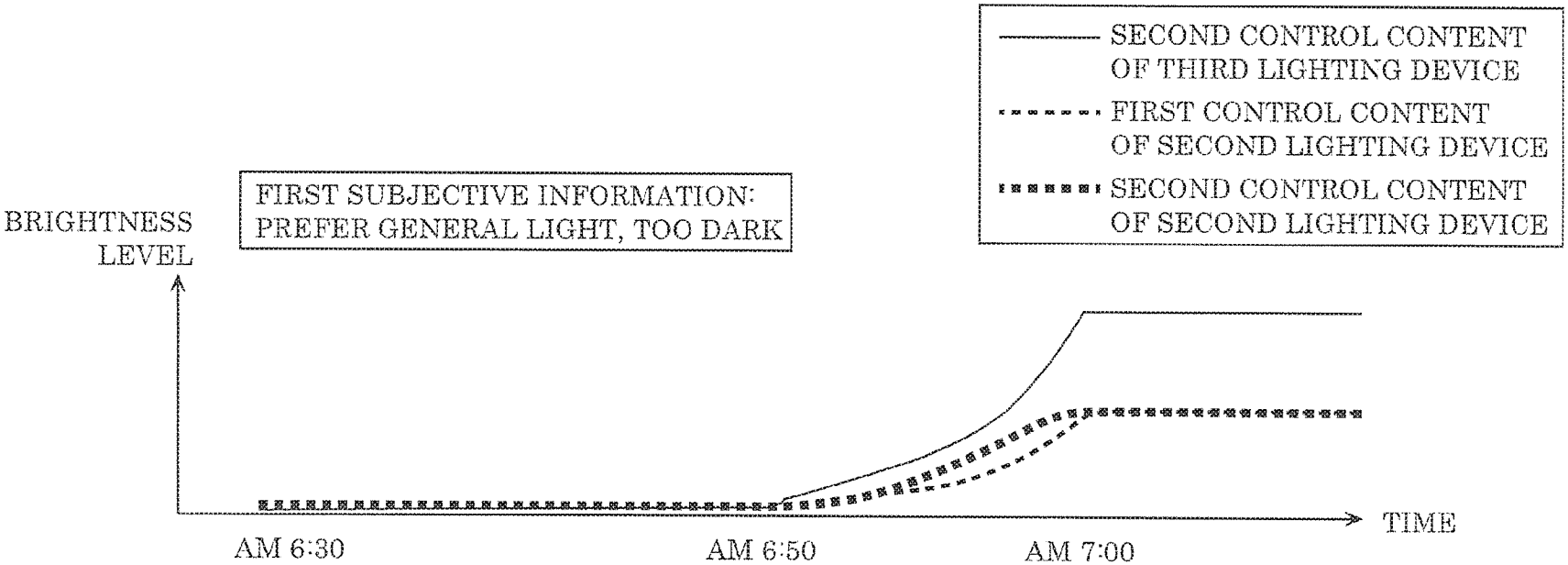
FIG. 14 is a diagram which illustrates an example of control content related to the brightness levels of the second lighting element and the third lighting element in the awaking mode of the lighting apparatus according to the embodiment.

FIG. 11 to FIG. 13 are diagrams each of which illustrates an example of control content related to the brightness levels of second lighting element 32 and third lighting element 33 in the awaking mode of lighting apparatus 10 according to the embodiment. FIG. 14 is a diagram which illustrates an example of control content related to the brightness levels of second lighting element 32 and third lighting element 33 in the awaking mode of lighting apparatus 10 according to the embodiment. It should be noted that, in FIG. 11 to FIG. 14, illustration of the first control content of third lighting element 33 is omitted. In operation example 2, when the first subjective information includes information indicating that a user prefers indirect light, controller 20 causes lighting device 30 to operate according to the second control content wider which the brightness level of third lighting element 33 is less than the brightness level of at least one of first lighting element 31 and second lighting element 32. Since first lighting element 31 is turned off in operation example 2, controller 20 causes lighting device 30 to operate according to the second control content under which the brightness level of third lighting element 33 is less than the brightness level of second lighting element 32. In addition, in operation example 2, when the first subjective information includes information indicating that the light which a user prefers is not indirect light but general light, controller 20 causes lighting device 30 to operate according to the second control content under which the brightness level of third lighting element 33 is greater than the brightness level of at least one of first lighting element 31 and second lighting element 32. Since first lighting element 31 is turned off in operation example 2, controller 20 causes lighting device 30 to operate according to the second control content under which the brightness level of third lighting element 33 is greater than the brightness level of second lighting element 32.

FIG. 11 illustrates an example of control content related to the brightness level of each of second lighting element 32 and third lighting element 33 in the sleeping mode when the first subjective information indicating that the user prefers indirect light and that the light was too bright is input. Controller 20, for example, in a predetermined mode (sleeping mode), turns on or keeps turned on (activate) at least one of first lighting element 31 and second lighting element 32, and gradually decreases the brightness level of third lighting element 33. Here, since first lighting element 31 is turned off, controller 20 turns on or keeps turned on second lighting element 32 and gradually decreases the brightness level of third lighting element 33. Furthermore, controller 20 also gradually decreases the brightness level of second lighting element 32. As one example, controller 20 gradually decreases the brightness level of third lighting element 33 from a few minutes before the scheduled time of sleep (shortly after 10:40 p.m.). Since the first subjective information includes information indicating that the user prefers indirect light, controller 20 causes lighting device 30 to operate according to the second control content under which the brightness level of third lighting element 33 is less than the brightness level of second lighting element 32 from the scheduled time of sleep (11:00 p.m.) onward. In addition, since the first subjective information includes information indicating that the light was too bright, controller 20 causes lighting device 30 to operate according to the second control content under which the brightness level of second lighting element 32 is less than the brightness level according to the first control content.

FIG. 12 illustrates an example of control content related to the brightness level of each of second lighting element 32 and third lighting element 33 in the sleeping mode when the first subjective information indicating that the user prefers indirect light and that the light was too bright is input. Controller 20, for example, in a predetermined mode (sleeping mode), turns on or keeps turned on at least one of first lighting element 31 and second lighting element 32, and turns off or keeps turned off third lighting element 33 (deactivate). Here, since first lighting element 31 is turned off, controller 20 turns on or keeps turned on second lighting element 32 and turns off or keeps turned off third lighting element 33. As one example, controller 20 turns off or keeps turned off third lighting element 33 from a predetermined period of time before the scheduled time of sleep (10:50 p.m.). Since the first subjective information includes information indicating that the user prefers indirect light, controller 20 causes lighting device 30 to operate according to the second control content under which the brightness level of third lighting element 33 is less than the brightness level of second lighting element 32 from the predetermined period of time before the scheduled time of sleep (10:50 p.m.) onward. In addition, since the first subjective information includes information indicating that the light was too bright, controller 20 causes lighting device 30 to operate according to the second control content under which the brightness level of second lighting element 32 is less than the brightness level according to the first control content.

FIG. 13 illustrates an example of control content related to the brightness level of each of second lighting element 32 and third lighting element 33 in the sleeping mode when the first subjective information indicating that the user prefers general light and that the light was too bright is input. Controller 20, for example, in a predetermined mode (sleeping mode), turns on or keeps turned on at least one of first lighting element 31 and second lighting element 32, and gradually decreases the brightness level of third lighting element 33. Here, since first lighting element 31 is turned off, controller 20 turns on or keeps turned on second lighting element 32 and gradually decreases the brightness level of third lighting element 33. As one example, controller 20 gradually decreases the brightness level of third lighting element 33 from a predetermined period of time before the scheduled time of sleep (10:50 p.m.). Since the first subjective information includes information indicating that the user prefers general light, controller 20 causes lighting device 30 to operate according to the second control content under which the brightness level of third lighting element 33 is greater than the brightness level of second lighting element 32 from the predetermined period of time before the scheduled time of sleep (10:50 p.m.) onward. In addition, since the first subjective information includes information indicating that the light was too bright, controller 20 causes lighting device 30 to operate according to the second control content under which the brightness level of second lighting element 32 is less than the brightness level according to the first control content.

FIG. 14 illustrates an example of control content related to the brightness level of each of second lighting element 32 and third lighting element 33 in the awaking mode when the first subjective information indicating that the user prefers general light and that the light was too dark is input. Controller 20, for example, in a predetermined mode (awaking mode), turns on or keeps turned on at least one of first lighting element 31 and second lighting element 32, and gradually increases the brightness level of third lighting element 33. Here, since first lighting element 31 is turned off, controller 20 turns on or keeps turned on second lighting element 32 and gradually increases the brightness level of third lighting element 33. As one example, controller 20 gradually increases the brightness level of third lighting element 33 from a predetermined period of time before the scheduled wake-up time (6:50 a.m.). Since the first subjective information includes information indicating that the user prefers general light, controller 20 causes lighting device 30 to operate according to the second control content under which the brightness level of third lighting element 33 is greater than the brightness level of second lighting element 32 from the predetermined period of time before the scheduled wake-up time (6:50 a.m.) onward. In addition, since the first subjective information includes information indicating that the light was too dark, controller 20 causes lighting device 30 to operate according to the second control content under which the brightness level of second lighting element 32 is greater than the brightness level according to the first control content.

It should be noted that, although first lighting element 31 is turned off in operation example 2, first lighting element 31 may be turned on. Alternatively, first lighting element 31 may be turned on and second lighting element 32 may be turned off.

Although the brightness level of lighting device 30 is varied according to time under the control content in a predetermined mode in the fundamental operation, operation example 1, and operation example 2, a color temperature may be also varied according to time. The following describes, as operation example 3 of lighting apparatus 10, an example in which, in a predetermined mode, first lighting element 31 and second lighting element 32 are caused to operate according to control content under which brightness level and a color temperature are varied. It should be noted that, third lighting element 33 is turned off in operation example 3.

[Operation Example 3 of Lighting Apparatus]

Figure 15:
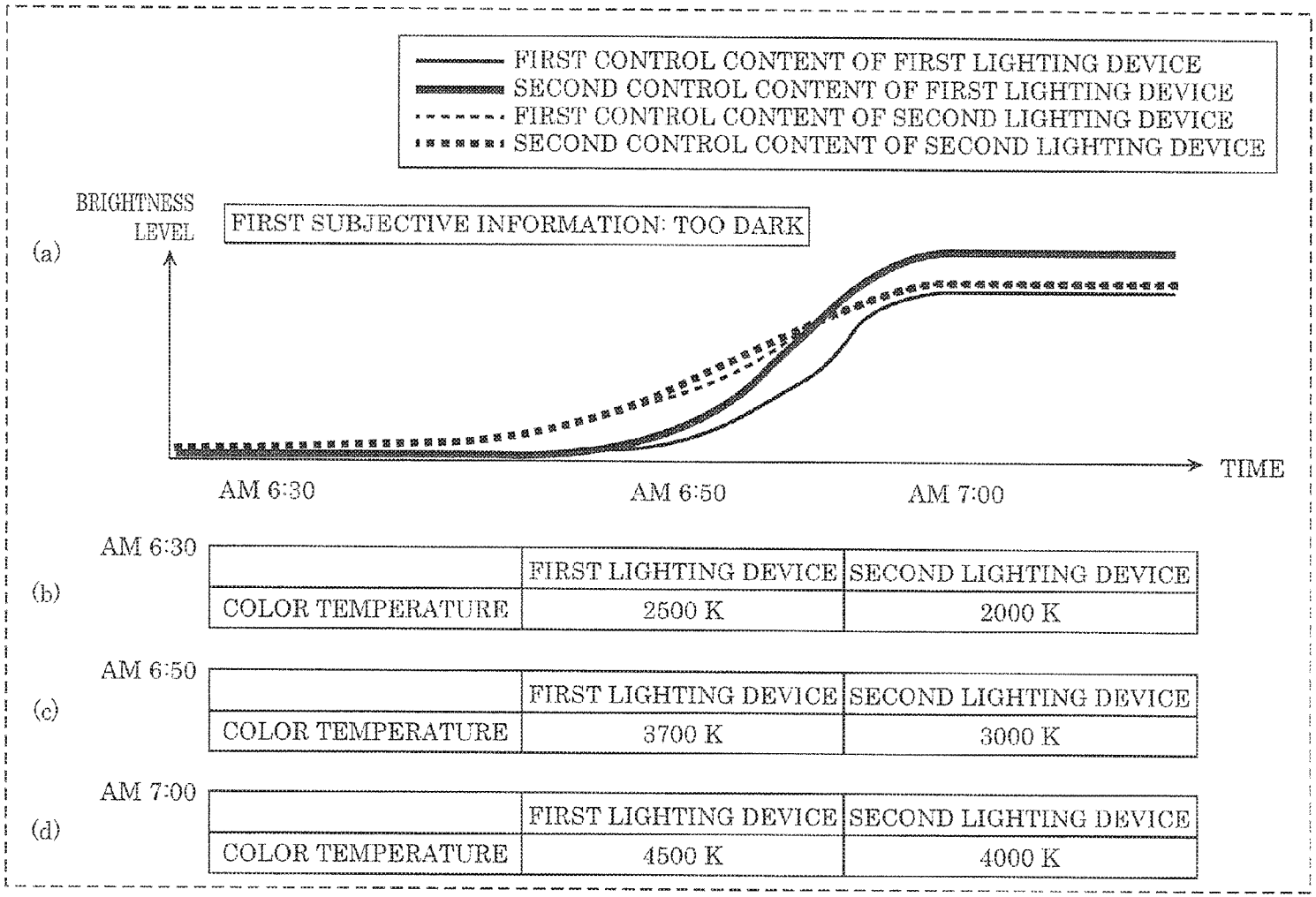
FIG. 15 is a diagram which illustrates an example of control content related to the brightness levels and color temperatures of the first lighting element and the second lighting element in the awaking mode of the lighting apparatus according to the embodiment.

FIG. 15 is a diagram which illustrates an example of control content related to the brightness level and the color temperature of each of first lighting element 31 and second lighting element 32 in the awaking mode of lighting apparatus 10 according to the embodiment. More specifically, FIG. 15 illustrates an example of control content related to the brightness level and the color temperature of each of first lighting element 31 and second lighting element 32 in the awaking mode when the first subjective information indicating that the light was too dark is input.

When the first subjective information includes information indicating that lighting device 30 was too dark at a wake-up time of the user, controller 20 causes, among first lighting element 31 and second lighting element 32, a lighting device that emits light having a first blue component intensity (for example, 460 nm to 480 nm) to be greater in a rate of increase in a brightness level according to the second control content with respect to a brightness level according to the first control content than a lighting device that emits light having a second blue component intensity less than the first blue component intensity. For example, first lighting element 31 emits light of a cold color having a higher color temperature than second lighting element 32, and second lighting element 32 emits light of a warm color having a lower color temperature than first lighting element 31. Accordingly, the lighting device that emits light having the second blue component intensity less than the first blue component intensity is second lighting element 32, and the lighting device that emits light having the first blue component intensity greater than the second blue component intensity is first lighting element 31. In other words, controller 20 causes first lighting element 31 to be greater in the rate of increase in the brightness level according to the second control content with respect to the brightness level according to the first control content, than second lighting element 32. As indicated by (a) in FIG. 15, the rate of increase in the brightness level according to the second control content with respect to the brightness level according to the first control content of second lighting element 32 is small, and the rate of increase in the brightness level according to the second control content with respect to the brightness level according to the first control content of first lighting element 31 is great.

In addition, as indicated by (b) to (d) in FIG. 15, in the case where the first subjective information includes information indicating that lighting device 30 was too dark at a wake-up time of the user, the color temperature of each of first lighting element 31 and second lighting element 32 may be gradually increased. When the color temperature of lighting device 30 gradually increases from a predetermined period of time before the scheduled wake-up time, it is easy to enable a user to awake pleasantly. In addition, although not illustrated, when the color temperature of lighting device 30 gradually decreases from a predetermined period of time before the scheduled time of sleep, it is easy to enable a user to easily fall asleep.

It should be noted that vividness of a color of light may also be varied according to time. The following describes, as operation example 4 of lighting apparatus 10, an example in which, in a predetermined mode, first lighting element 31 and second lighting element 32 are caused to operate according to control content under which saturation is varied. It should be noted that third lighting element 33 is turned off in operation example 4.

[Operation Example 4 of Lighting Apparatus]

Figure 16:
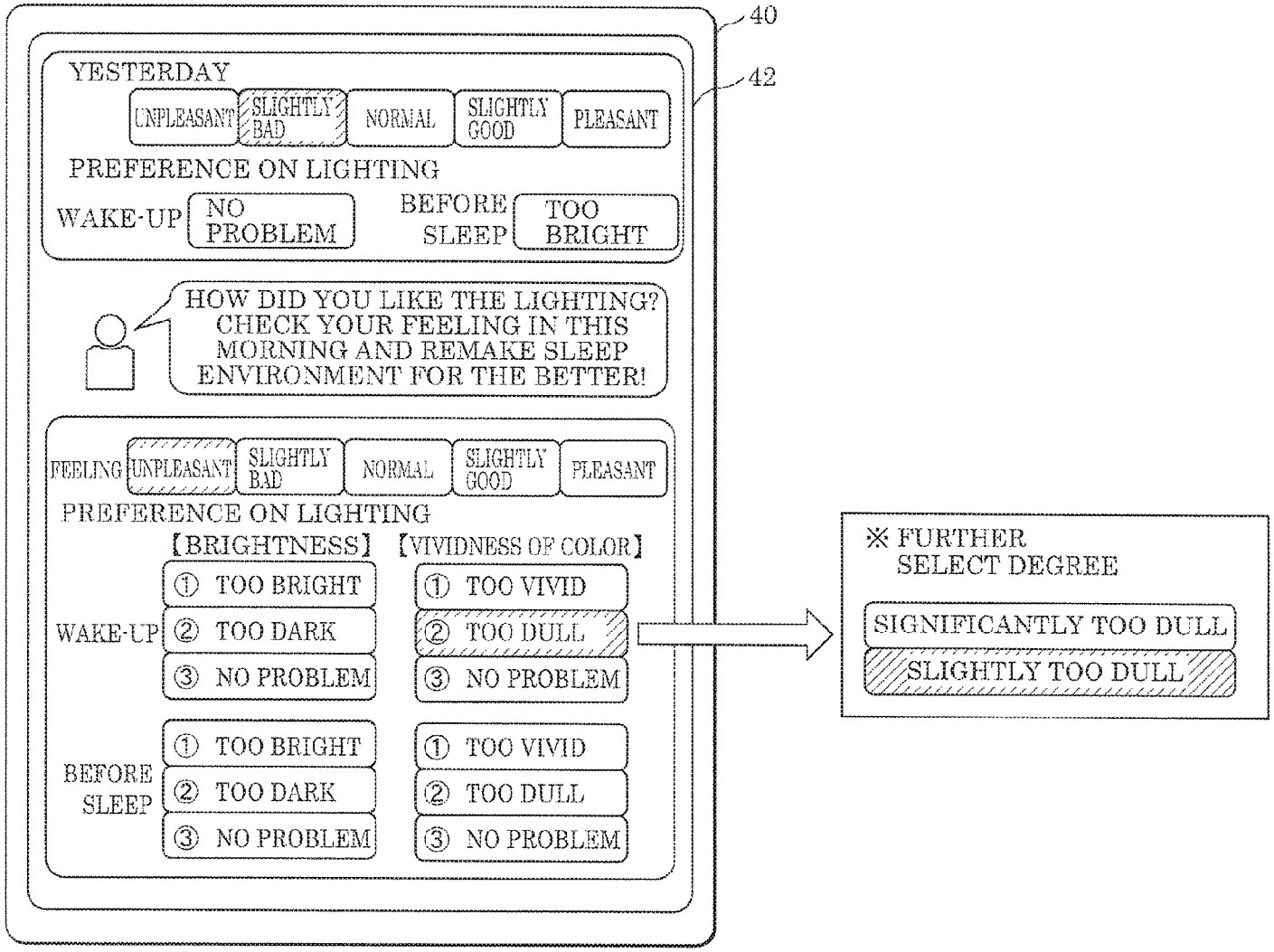
FIG. 16 is a diagram which indicates that subjective information related to vividness of a color can be input in a displayed image of the display according to the embodiment.

As illustrated in FIG. 16, in order to reflect vividness of a color in the control content, display 42 may display an image for enabling a user to input feedback on vividness of a color according to the first control content.

FIG. 16 is a diagram which indicates that subjective information related to vividness of a color can be input in the displayed image of display 42 according to the embodiment. It should be noted that FIG. 16 illustrates an image displayed by display 42 after first lighting element 31 and second lighting element 32 were caused to operate according to the first control content. The displayed image illustrated in FIG. 16 includes the previous subjective information on the upper side of display 42, so as to facilitate inputting of the first subjective information by a user.

A user inputs feedback on the first control content regarding vividness of a color of lighting device 30 in the awaking mode, by selecting any of the icons labeled as "too vivid", "too dull", and "no problem" in a section indicated by "wake-up" in FIG. 16. In the same manner as above, the user inputs feedback on the first control content regarding vividness of a color of lighting device 30 in the sleeping mode, by selecting any of the icons labeled as "too vivid", "too dull", and "no problem" in a section indicated by "before sleep" in FIG. 16.

In addition, as the feedback on the first control content of lighting device 30 in the awaking mode and the sleeping mode, to what degree the color of lighting device 30 was too vivid or too dull may further be input as illustrated in FIG. 16, in addition to inputting "too vivid", "too dull", or "no problem".

Next, an example of control content related to saturation of first lighting element 31 and second lighting element 32 in the awaking mode, for example, will be described with reference to FIG. 17.

Figure 17:
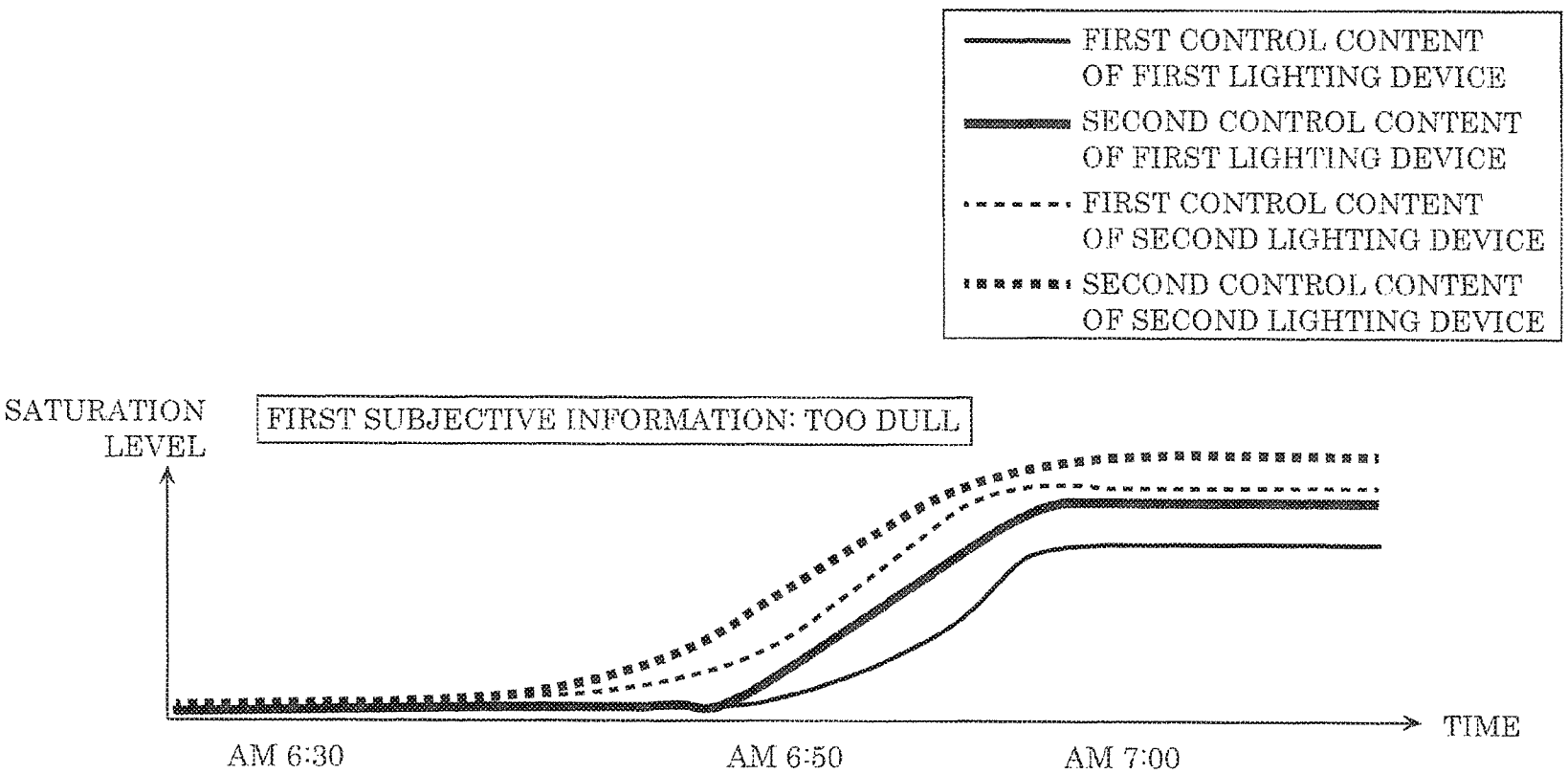
FIG. 17 is a diagram which illustrates an example of control content related to saturation of the first lighting element and the second lighting element in the awaking mode of the lighting apparatus according to the embodiment.

FIG. 17 is a diagram which illustrates an example of control content related to the saturation of each of first lighting element 31 and second lighting element 32 in the awaking mode of lighting apparatus 10 according to the embodiment.

FIG. 17 illustrates an example of the control content related to the saturation of each of first lighting element 31 and second lighting element 32 in the awaking mode when the first subjective information indicating that the vividness was too dull is input. Since the first subjective information includes information indicating that the vividness was too dull, controller 20 causes lighting device 30 to operate according to the second control content under which the vividness of each of first lighting element 31 and second lighting element 32 is greater than the vividness according to the first control content.

Further, the brightness level of light may be controlled so as to fluctuate according to time. The following describes, as operation example 5 of lighting apparatus 10, an example in which, in a predetermined mode, lighting device 30 is caused to operate according to control content under which the brightness level of lighting device 30 fluctuates according to time.

[Operation Example 5 of Lighting Apparatus]

Figure 18:
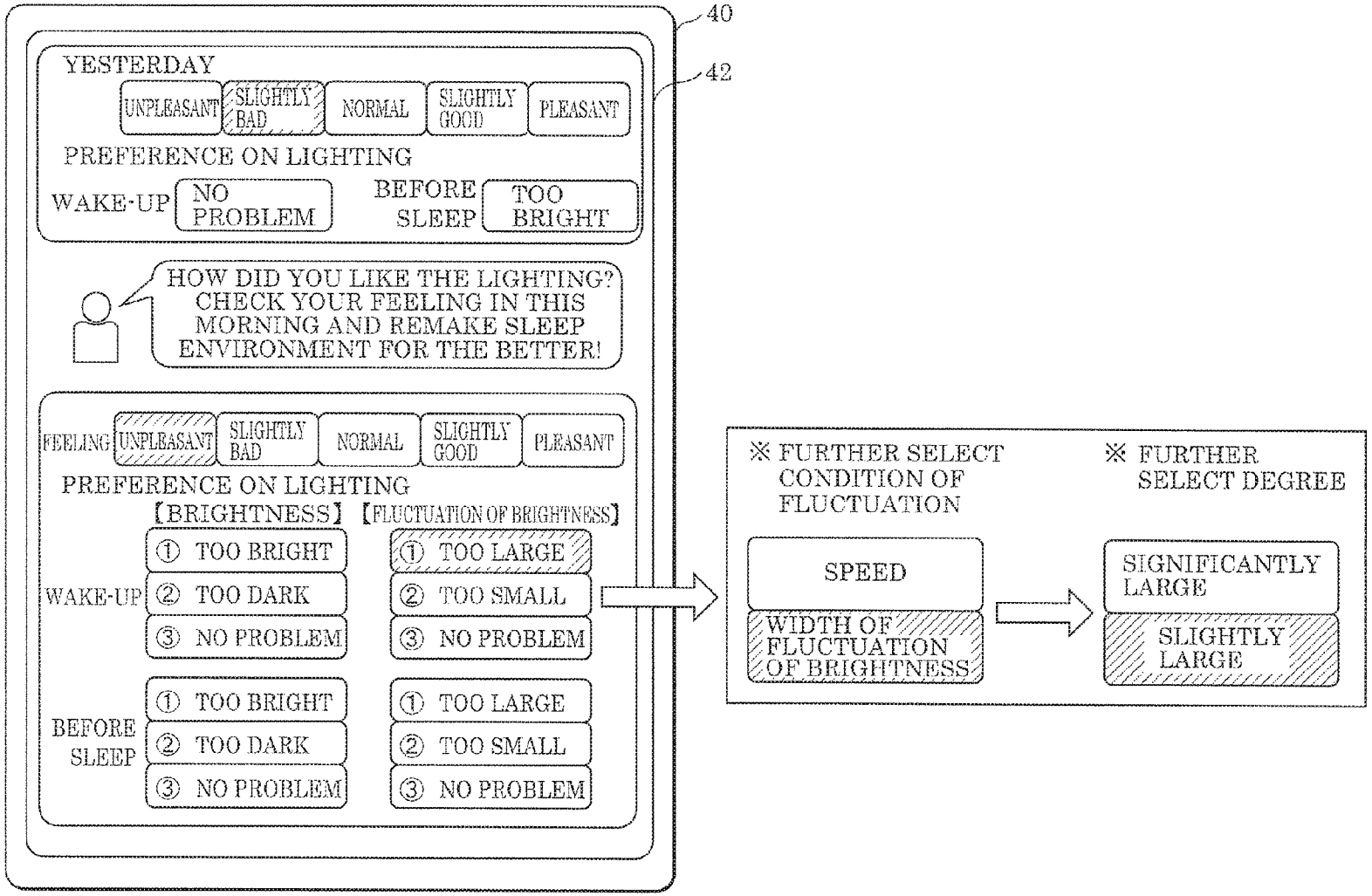
FIG. 18 is a diagram which indicates that subjective information related to fluctuation of the brightness level can be input in a displayed image of the display according to the embodiment.

As illustrated in FIG. 18, in order to reflect fluctuation of brightness level in the control content, display 42 may display an image for enabling a user to input feedback on fluctuation of brightness level according to the first control content.

FIG. 18 is a diagram which indicates that subjective information related to fluctuation of brightness level can be input in the displayed image of display 42 according to the embodiment. It should be noted that FIG. 18 illustrates an image displayed by display 42 after lighting device 30 is caused to operate according to the first control content. The displayed image illustrated in FIG. 18 includes the previous subjective information on the upper side of display 42, so as to facilitate inputting of the first subjective information by a user.

A user inputs feedback on the first control content regarding the fluctuation of brightness level of lighting device 30 in the awaking mode, by selecting any of the icons labeled as "too large", "too small", and "no problem" in a section indicated by "wake-up" in FIG. 18. In the same manner as above, the user inputs feedback on the first control content regarding the fluctuation of brightness level of lighting device 30 in the sleeping mode, by selecting any of the icons labeled as "too large", "too small", and "no problem" in a section indicated by "before sleep" in FIG. 18.

In addition, as the feedback on the first control content of lighting device 30 in the awaking mode and the sleeping mode, in addition to inputting "too large", "too small", or "no problem" regarding the fluctuation of brightness level of lighting device 30, to what degree a speed of the fluctuation was fast or slow, or to what degree a width of the fluctuation of brightness level was large or small may further be input by the user, as illustrated in FIG. 18.

Next, an example of control content related to the fluctuation of the brightness level of lighting device 30 will be described with reference to FIG. 19.

Figure 19:
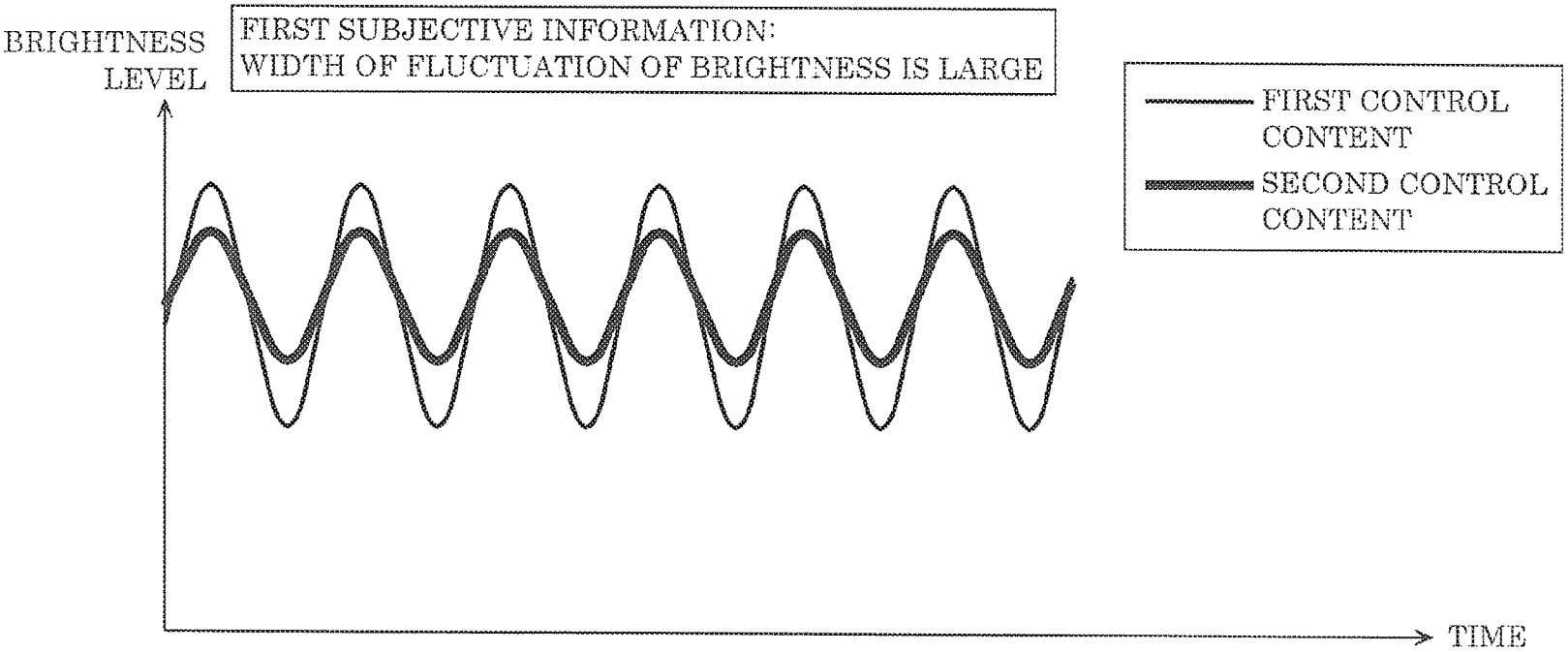
FIG. 19 is a diagram which illustrates an example of control content related to the fluctuation of the brightness level of the lighting device of the lighting apparatus according to the embodiment.

FIG. 19 is a diagram which illustrates an example of control content related to the fluctuation of brightness level of lighting device 30 of lighting apparatus 10 according to the embodiment.

FIG. 19 illustrates an example of control content related to the fluctuation of brightness level of lighting device 30 when the first subjective information indicating that the width of the fluctuation of brightness level was too large is input. Since the first subjective information includes information indicating that the width of the fluctuation of brightness level was too large, controller 20 causes lighting device 30 to operate according to the second control content under which the width of the fluctuation of brightness level of lighting device 30 is smaller than the width of the fluctuation of brightness level of lighting device 30 according to the first control content.

Further, a color of light may be controlled so as to fluctuate according to time. The following describes, as operation example 6 of lighting apparatus 10, an example in which, in a predetermined mode, lighting device 30 is caused to operate according to control content under which a color of light emitted by lighting device 30 fluctuates according to time.

[Operation Example 6 of Lighting Apparatus]

Figure 20:
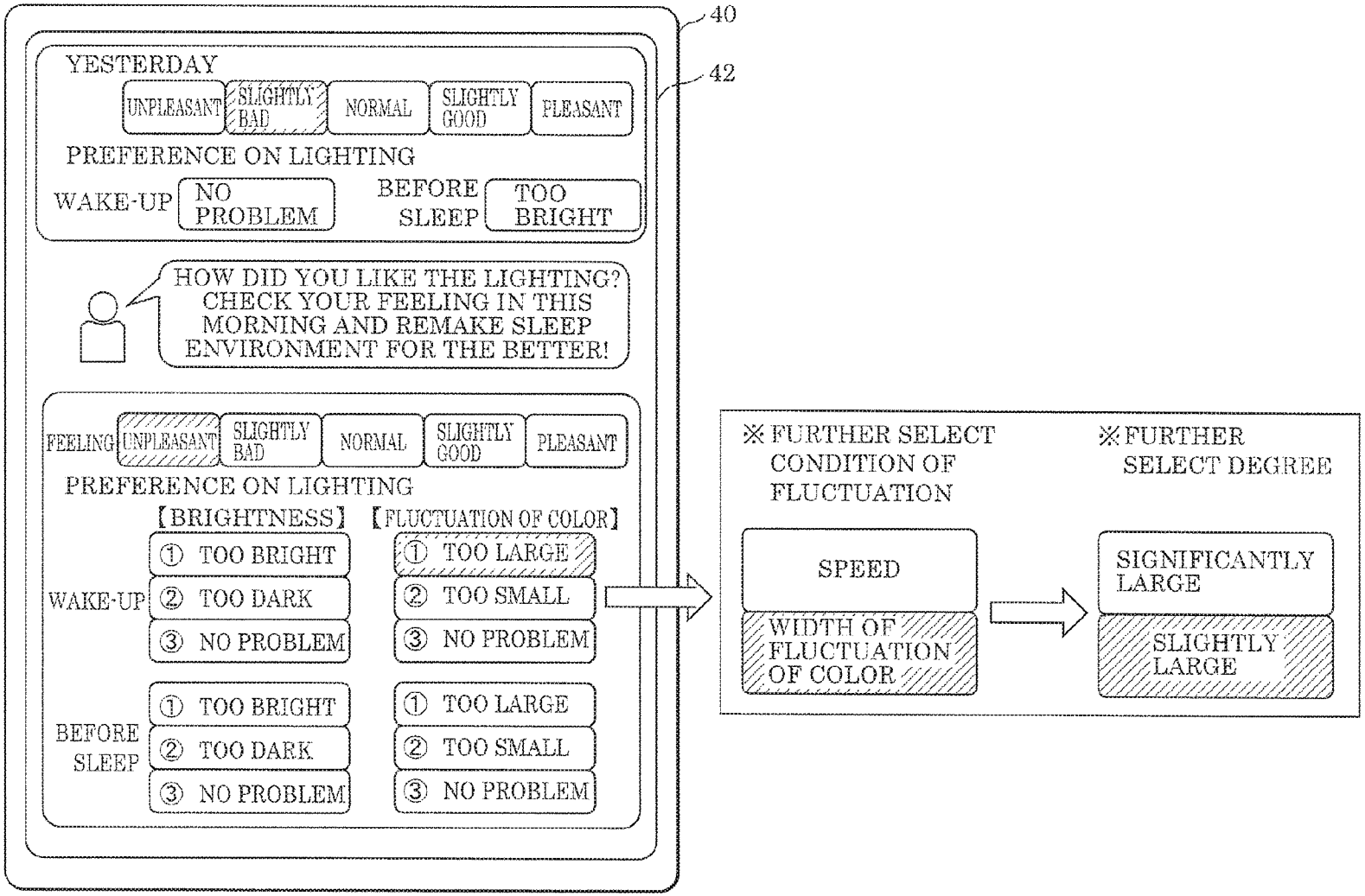
FIG. 20 is a diagram which indicates that subjective information related to fluctuation of a color can be input in a displayed image of the display according to the embodiment.

As illustrated in FIG. 20, in order to reflect fluctuation of a color in the control content, display 42 may display an image for enabling a user to input feedback on fluctuation of a color according to the first control content.

FIG. 20 is a diagram which indicates that subjective information related to fluctuation of a color can be input in the displayed image of display 42 according to the embodiment. It should be noted that FIG. 20 illustrates an image displayed by display 42 after lighting device 30 is caused to operate according to the first control content. The displayed image illustrated in FIG. 20 includes the previous subjective information on the upper side of display 42, so as to facilitate inputting of the first subjective information by a user.

A user inputs feedback on the first control content regarding fluctuation of a color of lighting device 30 in the awaking mode, by selecting any of the icons labeled as "too large", "too small", and "no problem" in a section indicated by "wake-up" in FIG. 20. In the same manner as above, the user inputs feedback on the first control content regarding the fluctuation of a color of lighting device 30 in the sleeping mode, by selecting any of the icons labeled as "too large", "too small", and "no problem" in a section indicated by "before sleep" in FIG. 20.

In addition, as the feedback on the first control content of lighting device 30 in the awaking mode and the sleeping mode, in addition to inputting "too large", "too small", or "no problem" regarding the fluctuation of a color of lighting device 30, to what degree a speed of the fluctuation was fast or slow, or to what degree a width of the a color was large or small may further be input by the user, as illustrated in FIG. 20.

Next, an example of control content related to the fluctuation of a color of lighting device 30 will be described with reference to FIG. 21.

Figure 21:
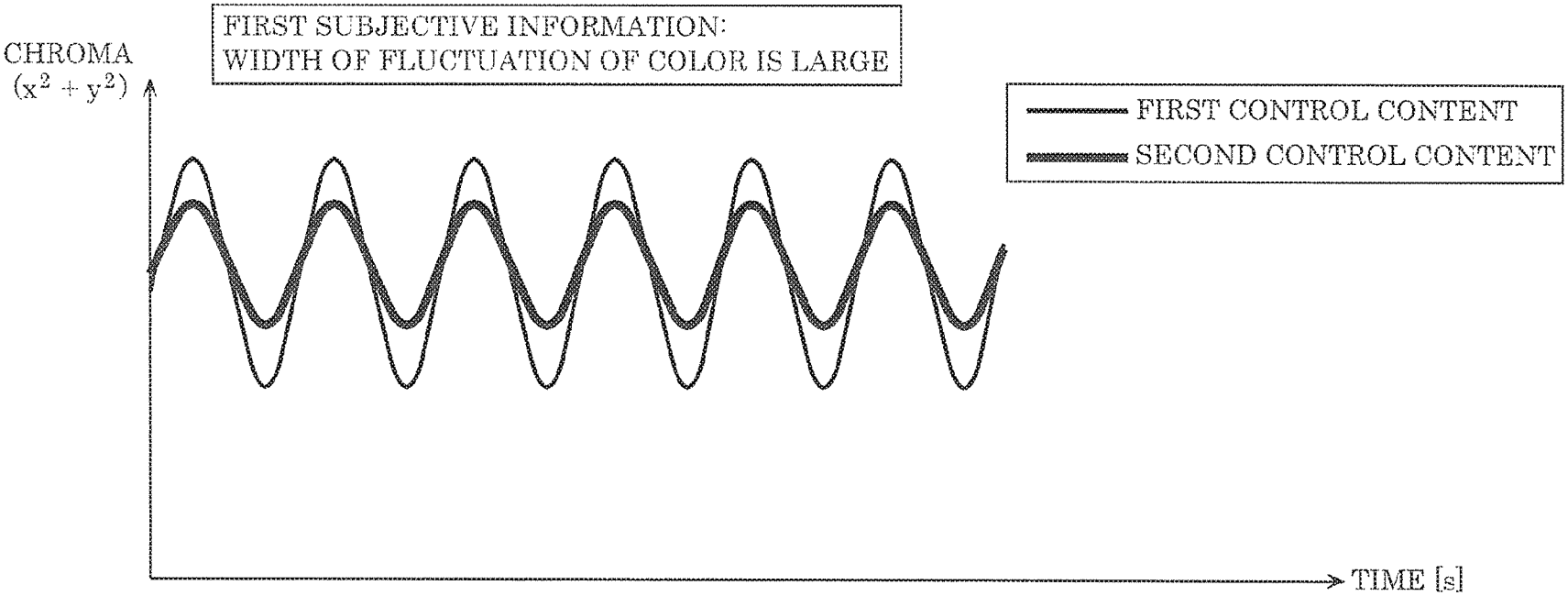
FIG. 21 is a diagram which illustrates an example of control content related to the fluctuation of a color of the lighting device of the lighting apparatus according to the embodiment.

FIG. 21 is a diagram which illustrates an example of control content related to the fluctuation of a color of lighting device 30 of lighting apparatus 10 according to the embodiment.

FIG. 21 illustrates an example of control content related to the fluctuation of a color (chroma: a sum of a square of x-coordinate value and a square of y-coordinate value on xy chromaticity diagram) of lighting device 30 when the first subjective information indicating that the width of the fluctuation of a color was too large is input. Since the first subjective information includes information indicating that the width of the fluctuation of the color was too large, controller 20 causes lighting device 30 to operate according to the second control content under which the width of the fluctuation of the color of lighting device 30 is smaller than the width of the fluctuation of the color of lighting device 30 according to the first control content.

Advantageous Effects, Etc.

Lighting apparatus 10 according to the embodiment includes: lighting device 30; and controller 20 which receives, from lighting setter 40, an instruction for causing lighting device 30 to operate in a predetermined mode, causes lighting device 30 to operate in the predetermined mode according to first control content, and subsequently receives the instruction, causes lighting device 30 to operate in the predetermined mode according to second control content which is modified from the first control content based on first subjective information input to lighting setter 40, the first subjective information indicating feedback of a user on the first control content.

In this manner, upon input of feedback on the first control content (the previous control content) to lighting setter 40 by a user, controller 20 causes lighting device 30 to operate according to second control content which reflects the first subjective information indicating the feedback input by the user. In other words, the user only has to, for example, input to lighting setter 40 feedback on control content which the user experiences on a daily basis without having to perform fine settings to cause lighting device 30 to operate in a predetermined mode according to control content which meets the user's preference, and then the control content of lighting device 30 is automatically approximated to the control content that meets the user's preference. In this manner, it is possible to easily obtain control content of lighting device 30 which meets the user's preference.

In addition, lighting setter 40 includes input interface 41, and controller 20 receives the instruction from lighting setter 40 as a result of input interface 41 receiving a predetermined operation.

In this manner, in order to cause lighting apparatus 10 to operate in a predetermined mode, the user presses a predetermined button or taps a predetermined icon of lighting setter 40, for example, as the predetermined operation performed on input interface 41. In other words, the user does not have to perform fine settings to cause lighting device 30 to operate in a predetermined mode according to control content which meets the user's preference, and only has to perform a predetermined operation.

In addition, lighting setter 40 includes display 42, and display 42 displays a first list of first predetermined comments each indicating the first subjective information for the user to select one of the first predetermined comments, an image for enabling the user to input the first subjective information, after controller 20 causes lighting device 30 to operate according to the first control content.

In this manner, for example, it is possible to visually input the first subjective information via display 42 of lighting setter 40, such as a mobile terminal, etc.

In addition, display 42 displays a second list of second predetermined comments each indicating second subjective information indicating feedback of the user on the second control content, after controller 20 causes lighting device 30 to operate according to the second control content, and the display also displays the first subjective information input after controller 20 causes lighting device 30 to operate according to the first control content.

In this manner, it is possible for a user to input second subjective information (subjective information input this time) related to the second control content (control content experienced this time) while checking the first subjective information (subjective information previously input).

In addition, the predetermined mode is a mode including at least one of an awaking mode for causing lighting device 30 to operate according to specific control content on or before a scheduled wake-up time of the user and a sleeping mode for causing lighting device 30 to operate according to specific control content on or before a scheduled time of sleep of the user.

In this manner, lighting apparatus 10 can enable the user to awake pleasantly when operating in the awaking mode, and can enable the user to easily fall asleep when operating in the sleeping mode.

In addition, lighting apparatus 10 further includes body 11 for lighting apparatus 10 to be attached to a structure, and lighting device 30 includes first lighting element 31 which emits light in a rearward direction toward a structure to which the main body is attached.

In this manner, it is possible to generate indirect light by causing light emitted by first lighting element 31 to be reflected by a structure (a ceiling, a wall, or the like). Accordingly, it is possible to enable the user to be relaxed in the sleeping mode, for example.

In addition, lighting device 30 further includes second lighting element 32, and first lighting element 31 and second lighting 32 device are each independently controlled in color.

In this manner, it is possible to generate gradation similar to morning glow or dusk.

In addition, second lighting element 32 emits light in the rearward direction.

In this manner, it is possible to generate indirect light by first lighting element 31 and second lighting element 32 which are capable of being independently controlled in color.

In addition, lighting device 30 further includes third lighting element 33 which emits light in a forward direction opposite to the rearward direction.

In this manner, it is possible to generate general light (direct light). Accordingly, it is possible to enable a user to easily awake in the awaking mode, for example.

In addition, in the predetermined mode, controller 20 turns on or keeps turned on at least one of first lighting element 31 and second lighting element 32, and turns off or keeps turned off third lighting element 33.

In this manner, for example, since general light is not generated in the sleeping mode, it is possible to enable a user who prefers indirect light to easily fall asleep.

In addition, in the predetermined mode, controller 20 turns on or keeps turned on at least one of first lighting element 31 and second lighting element 32, and gradually decreases a brightness level of third lighting element 33.

This prevents, for example, a bedroom from being suddenly darkened in the sleeping mode, and thus it is possible to enable a user who has a problem with darkness to easily fall asleep.

In addition, in the predetermined mode, controller 20 turns on or keeps turned on at least one of first lighting element 31 and second lighting element 32, and gradually increases a brightness level of third lighting element 33.

This prevents, for example, a bedroom from suddenly becoming bright in the awaking mode, and thus it is possible to enable a user to awake pleasantly.

In addition, when the first subjective information includes information indicating that the user prefers indirect light, controller 20 causes lighting device 30 to operate according to the second control content under which a brightness level of third lighting element 33 is less than a brightness level of at least one of first lighting element 31 and second lighting element 32, and when the first subjective information includes information indicating that the user prefers light other than indirect light, controller 20 causes lighting device 30 to operate according to the second control content under which a brightness level of third lighting element 33 is greater than a brightness level of at least one of first lighting element 31 and second lighting element 32.

In this manner, it is possible to decrease the brightness level of direct light in a predetermined mode for a user who prefers indirect light, and increase the brightness level of direct light in a predetermined mode for a user who prefers light other than indirect light.

In addition, first lighting element 31 and second lighting element 32 include a lighting device that emits light having a first blue component intensity and a lighting device that emits light having a second blue component intensity less than the first blue component intensity, and when the first subjective information includes information indicating that the lighting device was too dark at a wake-up time of the user, controller 20 causes the lighting device that emits light having the first blue component intensity to be greater in a rate of increase in a brightness level according to the second control content with respect to a brightness level according to the first control content than the lighting device that emits light having the second blue component intensity.

Light which is high in the blue component intensity has an effect of decreasing secretion of melatonin of a person, that is, an effect of awaking a person. In addition, when the first subjective information (the subjective information previously input) includes information indicating that lighting device 30 was too dark at a wake-up time of the user, it is often the case that the user was unawakened at the wake-up time of the user. Accordingly, controller 20 increases, to a smaller degree, the brightness level of a lighting device which emits light low in the blue component intensity, from the brightness level of the lighting device according to the first control content, and increases, to a greater degree, the brightness level of a lighting device which emits light high in the blue component intensity, from the brightness level of the lighting device according to the first control content. In this manner, it is possible to enable the user to easily awake at a wake-up time of the user.

Lighting system 1 according to the embodiment includes: lighting apparatus 10; and lighting setter 40 connected to lighting apparatus 10 by wire or radio.

In this manner, it is possible to provide lighting system 1 which is capable of easily obtaining control content of lighting device 30 that meets a user's preference.

In addition, lighting setter 40 is a mobile terminal.

In this manner, it is possible for a user to easily obtain control content of lighting device 30 which meets the user's preference, using a mobile terminal.

Other Embodiments

Lighting apparatus 10 and lighting system 1 according to the embodiment are described thus far. However, the present disclosure is not limited to the above-described embodiment.

For example, although lighting device 30 includes first lighting element 31, second lighting element 32, and third lighting element 33 according to the foregoing embodiment, the configuration of lighting device 30 is not limited to this example. For example, lighting device 30 may include at least one of first lighting element 31, second lighting element 32, and third lighting element 33.

In addition, for example, although lighting apparatus 10 includes lighting device 30 according to the foregoing embodiment, lighting apparatus 10 may further include a speaker. With this configuration, a sound may be output in a predetermined mode to enable a user to awake more pleasantly and to more easily fall asleep.

In addition, for example, although controller 20 causes lighting device 30 to operate according to the second control content based on the first subjective information indicating feedback of a user on the first control content (previous control content) input to lighting setter 40 according to the foregoing embodiment, the present disclosure is not limited to this example. For example, controller 20 may cause lighting device 30 to operate according to control content (second control content) based on a plurality of subjective information items corresponding one-to-one to a plurality of past control content items (last one week, for example) which have been input to lighting setter 40. In this manner, it is possible to approximate control content to meet a user's preference.

In addition, for example, although controller 20 causes lighting device 30 to operate according to the second control content based on the first subjective information according to the foregoing embodiment, the present disclosure is not limited to this example. A user inputs, on a daily basis, to lighting setter 40, the subjective information which indicates whether or not the current control content is better than the previous control content, and thus the control content of lighting device 30 in a predetermined mode is approximated to the user's preference. After inputting the user's subjective information a certain number of times, the control content of lighting device 30 in a predetermined mode meets the user's preference, eliminating the necessity of inputting subjective information by the user to lighting setter 40. Accordingly, when the first subjective information is not input to lighting setter 40, controller 20 may cause lighting device 30 to operate according to the second control content having the same control content as the first control content.

In addition, the present disclosure can be implemented not only as lighting apparatus 10, but also as a method including steps (processes) performed by the structural components included in lighting apparatus 10.

For example, these steps may be executed by a computer (computer system). The present disclosure can be implemented as a program for causing the computer to execute the steps included in the method. Furthermore, the present disclosure can be implemented as a non-transitory computer-readable recording medium such as a compact disc read only memory (CD-ROM) on which the program is recorded.

For example, when the present disclosure is implemented by a program (software), each step is performed by executing the program using hardware resources such as a CPU, a memory, an input and output circuit, etc., of the computer. In other words, each of the steps is executed as a result of obtaining and computing data from the memory, the input and output circuit, etc. by the CPU, or outputting a result of the computing to the memory, the input and output circuit, etc. by the CPU, for example.

In addition, controller 20 according to the foregoing embodiments may be implemented as a dedicated or a general-purpose circuit.

In addition, controller 20 according to the foregoing embodiments may be implemented as a large scale integration (LSI) which is an integrated circuit (IC).

Furthermore, the integrated circuit is not limited to the LSI, and may be implemented by a dedicated circuit or a general-purpose processor. A field programmable gate array (FPGA) that is programmable, or a reconfigurable processor that is capable of reconfiguring connection and setting of circuit cells inside an LSI may be used.

Furthermore, when advancement in semiconductor technology or derivatives of other technologies brings forth a circuit integration technology which replaces LSI, it will be appreciated that such a circuit integration technology may be used in circuit integration for controller 20.

It should be noted that the present disclosure also includes other forms in which various modifications apparent to those skilled in the art are applied to the embodiments or forms in which structural components and functions in the embodiments are arbitrarily combined within the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus, comprising:

a lighting device; and a controller which:

receives, from a lighting setter, an instruction for causing the lighting device to operate in a predetermined mode;

causes the lighting device to operate in the predetermined mode according to first control content;

subsequently receives the instruction; and causes the lighting device to operate in the predetermined mode according to second control content which is modified from the first control content based on first subjective information input to the lighting setter, the first subjective information indicating feedback of a user on the first control content.

2. The lighting apparatus according to claim 1, wherein:

the lighting apparatus includes the lighting setter, the lighting setter includes an input interface, and the controller receives the instruction from the lighting setter as a result of the input interface receiving a predetermined operation.

3. The lighting apparatus according to claim 1, wherein:

the lighting apparatus includes the lighting setter, the lighting setter includes a display, and the display displays a first list of first predetermined comments each indicating the first subjective information for the user to select one of the first predetermined comments, after the controller causes the lighting device to operate according to the first control content.

4. The lighting apparatus according to claim 3, wherein:

the display displays a second list of second predetermined comments each indicating second subjective information indicating feedback of the user on the second control content, after the controller causes the lighting device to operate according to the second control content, and the display also displays the first subjective information input after the controller causes the lighting device to operate according to the first control content.

5. The lighting apparatus according to claim 1, wherein the predetermined mode is a mode including at least one of an awaking mode for causing the lighting device to operate according to specific control content on or before a scheduled wake-up time of the user and a sleeping mode for causing the lighting device to operate according to specific control content on or before a scheduled time of sleep of the user.

6. The lighting apparatus according to claim 1, wherein:

the lighting apparatus further includes a body for the lighting apparatus to be attached to a structure, and the lighting device includes a first lighting element which emits light in a rearward direction toward the structure when the body is attached to the structure.

7. The lighting apparatus according to claim 6, wherein the lighting device further includes a second lighting element, and color of the first lighting element and the second lighting element are each independently controlled.

8. The lighting apparatus according to claim 7, wherein the second lighting element emits light in the rearward direction.

9. The lighting apparatus according to claim 7, wherein the lighting device further includes a third lighting element which emits light in a forward direction opposite to the rearward direction.

10. The lighting apparatus according to claim 9, wherein, in the predetermined mode, the controller turns on or keeps turned on at least one of the first lighting element and the second lighting element, and turns off or keeps turned off the third lighting element.

11. The lighting apparatus according to claim 9, wherein:

the predetermined mode is a sleeping mode for causing the lighting device to operate according to specific control content on or before a scheduled time of sleep of the user, and in the sleeping mode, the controller turns on or keeps turned on at least one of the first lighting element and the second lighting element, and gradually decreases a brightness level of the third lighting element.

12. The lighting apparatus according to claim 9, wherein:

the predetermined mode is an awaking mode for causing the lighting device to operate according to specific control content on or before a scheduled wake-up time of the user, and in the awaking mode, the controller turns on or keeps turned on at least one of the first lighting element and the second lighting element, and gradually increases a brightness level of the third lighting element.

13. The lighting apparatus according to claim 9, wherein when the first subjective information includes information indicating that the user prefers indirect light, the controller causes the lighting device to operate according to the second control content under which a brightness level of the third lighting element is less than a brightness level of at least one of the first lighting element and the second lighting element, and when the first subjective information includes information indicating that the user prefers light other than indirect light, the controller causes the lighting device to operate according to the second control content under which a brightness level of the third lighting element is greater than a brightness level of at least one of the first lighting element and the second lighting element.

14. The lighting apparatus according to claim 7, wherein, the first lighting element and the second lighting element comprise a lighting device that emits light having a first blue component intensity and a lighting device that emits light having a second blue component intensity less than the first blue component intensity, and when the first subjective information includes information indicating that the lighting device was too dark at a wake-up time of the user, the controller causes the lighting device that emits light having the first blue component intensity to be greater in a rate of increase in a brightness level according to the second control content with respect to a brightness level according to the first control content than the lighting device that emits light having the second blue component intensity.

15. A lighting system, comprising:

the lighting apparatus according to claim 1; and the lighting setter connected to the lighting apparatus by wire or radio.

16. The lighting system according to claim 15, wherein the lighting setter is a mobile terminal.

17. The lighting system according to claim 15, wherein the lighting setter includes an input interface, and the controller receives the instruction from the lighting setter as a result of the input interface receiving a predetermined operation.

18. The lighting system according to claim 15, wherein: the lighting setter includes a display, and the display displays a first list of first predetermined comments each indicating the first subjective information for the user to select one of the first predetermined comments, after the controller causes the lighting device to operate according to the first control content.

* * * * *